US011033128B2

(12) United States Patent
Rohweller

(10) Patent No.: US 11,033,128 B2
(45) Date of Patent: Jun. 15, 2021

(54) THERMAL INSULATING STRUCTURE WITH ADJUSTABLE WARMTH CONTROL

(71) Applicant: David Rohweller, Ojai, CA (US)

(72) Inventor: David Rohweller, Ojai, CA (US)

( * ) Notice: Subject to any disclaimer, the term of this patent is extended or adjusted under 35 U.S.C. 154(b) by 302 days.

(21) Appl. No.: 16/385,208

(22) Filed: Apr. 16, 2019

(65) Prior Publication Data

US 2019/0328162 A1 Oct. 31, 2019

Related U.S. Application Data

(60) Provisional application No. 62/661,920, filed on Apr. 24, 2018.

(51) Int. Cl.

| | |
|---|---|
| ***A47G 9/08*** | (2006.01) |
| ***A41D 31/02*** | (2019.01) |
| ***A41D 1/02*** | (2006.01) |
| ***A47G 9/02*** | (2006.01) |

(52) U.S. Cl.

CPC ..... *A47G 9/086* (2013.01); *A41D 1/02* (2013.01); *A41D 31/02* (2013.01); *A47G 9/0215* (2013.01)

(58) Field of Classification Search

CPC ..... A47G 9/086; A47G 9/08; A47G 9/0215; A41D 1/02; A41D 31/02

See application file for complete search history.

(56) References Cited

U.S. PATENT DOCUMENTS

| | | | | |
|---|---|---|---|---|
| 2008/0201846 | A1* | 8/2008 | Soreano | A47G 9/0207 5/502 |
| 2010/0024701 | A1* | 2/2010 | Li | A47G 9/086 112/420 |
| 2011/0047699 | A1* | 3/2011 | Regan | A47G 9/0207 5/502 |

* cited by examiner

*Primary Examiner* — Fredrick C Conley

(74) *Attorney, Agent, or Firm* — Patrick Stanzione; Stanzione & Associates, PLLC

(57) ABSTRACT

A thermal insulating structure having insulation channels formed therein to receive insulation material, a movement channel extending along the insulation channels to disburse the insulation between the insulation channels and a storage channel to store insulation material not being used in the insulation channels. The movement channel, insulation channels and storage channel being integrally formed with each other while being partially obstructed from each other to maintain insulating material in the desired channels until moved to another one of the channels by a swiping or patting motion on the structure to provide a widely ranging temperature adjustable structure such as a sleeping bag, jacket, or comforter.

20 Claims, 16 Drawing Sheets

540
550
560
502a
502b
503b
503c

THERMAL INSULATING STRUCTURE WITH ADJUSTABLE WARMTH CONTROL

CROSS-REFERENCE TO RELATED APPLICATIONS

The application claims one or more inventions which were disclosed in Provisional Patent Application Ser. No. 62/661,920, filed on Apr. 24, 2018, entitled SLEEPING BAG WITH ADJUSTABLE WARMTH CONTROL. The benefit under 35 USC § 119(e) of the US provisional application is hereby claimed, the entire disclosure of which is incorporated by reference herein in its entirety.

BACKGROUND OF THE INVENTIVE CONCEPT

1. Field of the Invention

The present inventive concept pertains to the field of a thermal insulating structure including sleeping bags and comforters. More particularly, the invention pertains to a thermal insulating structure, such a sleeping bag, a comforter and a jacket, which includes adjustable warmth control features, such as a configuration to flexibly position insulating and heat retention material.

2. Description of the Related Art

Sleeping bags have outer coverings often referred to as shells, which have been formed of all types of materials including polyesters, cotton, nylon, etc. Sleeping bag shells are generally filled with a material to attempt to keep a human's body temperature within the sleeping bag at a consistently comfortable temperature during a time in which the human sleeps or rests. This attempt to keep a human's body consistently comfortable during a period of sleeping or resting is challenging in that the body heat of humans tends to drop as they sleep as well as the occurrence of wide variations in outdoor temperatures during different seasons, which can vary from one hour to the next during a single sleeping period.

Moreover, humans generally sleep at night when the outdoor temperatures are much cooler, and when the temperature continue to decrease throughout the night. Therefore, these shells have been known to be filled with all types of materials which can capture and retain body heat within the sleeping bag, such as fibers, cotton, polyester, and down feathers, among many other filler materials.

Some sleeping bags are generally stitched in order to prevent the filler materials from moving about inside the shells and to attempt to facilitate maintaining consistent and even warmth throughout the entire sleeping bag.

Other sleeping bags having down feather filler commonly use a stitching referred to as a "Karo-step" design, where stitching is provided in squares to keep a predetermined amount of the down feathers in each of the squares so that the down feathers remain evenly distributed about the whole sleeping bag. However, as pointed out above, outdoor temperatures in which sleeping bags are used vary widely from below freezing temperatures to fairly warm temperatures, the latter requiring a small amount of protection from becoming cold as one's body heat decreases when sleeping. Furthermore, it is very common for the outdoor temperatures to vary widely throughout a single night as one sleeps, and it is also common for one to go to sleep feeling cold, and then as the bag warms up from body heat, the temperature inside the sleeping bag can become too warm, or conversely, one may go to bed overheated from activity, and then as the night continues on, the body temperature cools and the temperature inside the sleeping bag becomes too cold.

Thus, for the above reasons, the sleeping bags with permanently distributed down feathers or other filler material are not sufficiently effective at keeping humans at a comfortable temperature during different seasons, as the outdoor temperatures tend to vary from season to season. Furthermore, these sleeping bags with permanently distributed down feathers, or other filler material, are not sufficiently effective at keeping humans at a comfortable temperature over the course of a single night of sleep as the outside temperature of one's body heat decreases through one night.

Additionally, sleeping bags and comforters with permanently distributed down feathers cannot adapt to each person's personal preferences in that some people get cold feet, or cold legs, or a cold head, and need more insulation at these locations. Conversely, some people get hot feet, or hot legs, or their head gets hot, and therefore need less insulation in these areas.

An ideal sleeping bag to keep humans sufficiently comfortable throughout a period of sleep would be adjustable with quick and simple actions performed by the user of the bag so as to accommodate external temperature variation, body heat variation, and personal preferences, and at the same time minimize the sleep disturbance if an adjustment needs to be made in the middle of the sleeping or resting period. Thus, there is a need for a thermal insulating structure, such as a sleeping bag or a comforter with insulating and heat retaining properties that can be adjustable in relationship to a human's body temperature, to external environmental temperatures, and to personal preferences, and at the same time be adjustable easily and quickly.

SUMMARY OF THE INVENTIVE CONCEPT

The present general inventive concept provides a thermal insulating structure, such as sleeping bags and comforters, including adjustable warmth control features, such as flexibility of positioning of insulating and heat retention material.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a thermal insulating structure, comprising: an enclosed shell of material having a front surface and a back surface with a length extending from a top to a bottom thereof and a width extending from a first side to a second side thereof, the length being greater than the width, the enclosed shell comprising: a plurality of baffles each extending along the width direction and in parallel with each other from the top to the bottom thereof, the plurality of baffles being configured to form a plurality of first channels therebetween, first and second ends of the baffles terminating short of respective first and second sides thereof; a cross baffle extending along the length direction at the second side thereof and configured to intersect each of the second ends of the plurality of baffles such that each of the first channels formed between the baffles is confined by the baffles and the cross baffle, the cross baffle forming a storage channel with the second side thereof and a space between a bottom most baffle and the bottom thereof and between a top most baffle and the top thereof; and a movement channel extending along a length thereof at the first side thereof and formed between the first side and each of the first ends of baffles such that a flow of insulating material freely moves between the movement channel and each of the plurality of first channels.

In an exemplary embodiment, thermal insulating structure may further comprise: a choke point formed between at least one of the first side thereof and the first end of the top most baffle and the first side thereof and the first end of the bottom most baffle, the at least one choke point configured to expand and contract at a point where the storage channel and the movement channel meet In another exemplary embodiment, thermal insulating structure may further comprise: a plurality of temperature indication lines formed on the front surface and extending along the length thereof from the top most baffle to the bottom most baffle and separated from each other by predetermined distance, the temperature indications lines being configured to provide an indication of how much insulation material to fill into each of the first channels to provide a certain degree of warmth.

In another exemplary embodiment, thermal insulating structure may further comprise: a plurality of buttons extending along the length of one of the first side and the second side thereof; and a plurality of button holes extending along the length of opposite one of the first side and the second side thereof, such that each button hole receives and retains a corresponding button.

In still another exemplary embodiment, thermal insulating structure may further comprise: a hook and loop system with a strip of hooks that adhere to a strip of loops, the strip of hooks being attached along a length of one of the first or second sides of the shell and the strip of loops being attached along a length of the other one of the first or second sides of the shell to adhere to each other such that the first side and the second side of the shell.

In still another exemplary embodiment, the thermal insulating structure may be a sleeping bag.

In still another exemplary embodiment, the thermal insulating structure may be a comforter.

The foregoing and/or other features and utilities of the present general inventive concept may also be achieved by providing a thermal insulating structure, comprising: a thermal insulating structure, comprising: a shell of material enclosed to form a hollow interior between a front surface, a back surface, a top, a bottom and first and second sides thereof, the shell comprising: a plurality of first baffles extending between the front and back surfaces thereof to form first channels therebetween, the plurality of first baffles each beginning at a first predetermined distance from the first side thereof and terminating at a second predetermined distance from the second side thereof, the second predetermined distance being greater than the first predetermined distance; a plurality of second baffles extending between the front and back surfaces thereof to form second channels therebetween, the plurality of second baffles extending between the top and the bottom thereof and being disposed within the second predetermined distance and spaced apart from each other by a third predetermined distance such that a first one of the second baffles extends across the terminating ends of the first baffles to block each of the first channels formed between the first baffles and a last one of the second baffles is disposed away from the second side thereof by the third predetermined distance to form one of the second channels therebetween, each of the second channels having an open communication with a space between a top most first baffle and the top of the shell and with a space between the bottom most baffle and the bottom of the shell.

In an exemplary embodiment, the thermal insulating structure may further comprise: a choke point disposed between the beginning of the top most first baffle and the first side of the shell and the beginning of the bottom most first baffle and the first side of the shell, each of the choke points configured to expand and contract to control the flow of insulating material between the first channels and the second channels.

In another exemplary embodiment, the thermal insulating structure may further comprise: a plurality of temperature indication lines formed on the front surface and extending from the top most first baffle and the bottom most first baffle and each separated predetermined distance, the temperature indications lines being configured to provide an indication of how much insulation material to fill into each of the first channels to provide a certain degree of warmth.

In still another exemplary embodiment, the thermal insulating structure may further comprise: a plurality of buttons extending along the length of one of the first side and the second side thereof; and a plurality of button holes extending along the length of opposite one of the first side and the second side thereof, such that each button hole receives and retains a corresponding button.

In still another exemplary embodiment, the thermal insulating structure may further comprise: a hook and loop system with a strip of hooks that adhere to a strip of loops, the strip of hooks being attached along a length of one of the first or second sides of the shell and the strip of loops being attached along a length of the other one of the first or second sides of the shell to adhere to each other such that the first side and the second side of the shell.

The foregoing and/or other features and utilities of the present general inventive concept may also be achieved by providing a thermal insulating structure, comprising: a shell formed of a predetermined material and being enclosed by a front surface and a back surface, a top portion and a bottom portion and a first side and a second side, the second side having a lower portion extending farther away from the first side than an upper portion, the shell comprising: a first set of baffles each having a first end and a second end and extending widthwise between the first and second sides of the shell to define first channels, the first ends of the first baffles being disposed a predetermined distance from the first side of the shell; a second set of baffles extending lengthwise along the lower portion of the second side, each of the second baffles being formed in sections, the sections crossing alternate first baffles, each second baffle crossing a first baffle not crossed by an adjacent second baffle such that the second baffles form labyrinths along the lower portion of the second side, and the last second baffle crossing the second end of alternative first baffles to form a second lengthwise channel with the second side of the shell; and a third single baffle extending lengthwise and crossing alternative first ends of the first baffles to form a lengthwise insulation movement channel therebetween.

In an exemplary embodiment, the thermal insulating structure may further comprise: a plurality of temperature indication lines formed on the front surface and each extending lengthwise a predetermined distance apart between the first ends of the first baffles and the second baffle formed farthest from the second side, the predetermined distance being determined to provide an indication of how much insulation material to fill into each of the first channels to provide a certain degree of warmth.

In another exemplary embodiment, the thermal insulating structure may further comprise: a plurality of buttons extending along the length of one of the first side and the second side thereof; and a plurality of button holes extending along the length of opposite one of the first side and the second side thereof, such that each button hole receives and retains a corresponding button.

In still another exemplary embodiment, the thermal insulating structure may further comprise: a hook and loop system with a strip of hooks that adhere to a strip of loops, the strip of hooks being attached along a length of one of the first or second sides of the shell and the strip of loops being attached along a length of the other one of the first or second sides of the shell to adhere to each other such that the first side and the second side of the shell.

In still another exemplary embodiment, the thermal insulating structure may further comprise: a second lengthwise insulation movement channel formed through each of the first baffles and disposed an equal distance between the first ends of the first baffles and the second baffle formed farthest from the lower portion of the second side of the shell.

The foregoing and/or other features and utilities of the present general inventive concept may also be achieved by providing a thermal insulating structure, comprising: a shell formed of a predetermined material and being enclosed by a front surface and a back surface, a top portion and a bottom portion and a first side and a second side, the second side having a lower portion extending farther away from the first side than an upper portion, the shell comprising: a first set of baffles each having a first end and a second end and extending widthwise between the first and second sides of the shell to define first channels, the first ends of the first baffles being disposed a predetermined distance from the first side of the shell; a second set of baffles extending lengthwise along the lower portion of the second side, each of the second baffles being formed in sections, the sections crossing alternate first baffles, each of the second baffles crossing the same first baffle to form a row of crosses along alternative first baffles, the last second baffle crossing the second end of alternative first baffles to form a second lengthwise channel with the second side of the shell; and a third single baffle extending lengthwise and crossing alternative first ends of the first baffles to form a lengthwise insulation movement channel therebetween.

In an exemplary embodiment, the thermal insulating structure may further comprise: a second lengthwise insulation movement channel formed through each of the first baffles and disposed an equal distance between the first ends of the first baffles and the second baffle formed farthest from the lower portion of the second side of the shell.

In another exemplary embodiment, the thermal insulating structure may further comprise: a hook and loop system with a strip of hooks that adhere to a strip of loops, the strip of hooks being attached along a length of one of the first or second sides of the shell and the strip of loops being attached along a length of the other one of the first or second sides of the shell to adhere to each other such that the first side and the second side of the shell.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figures 1A, 1B:
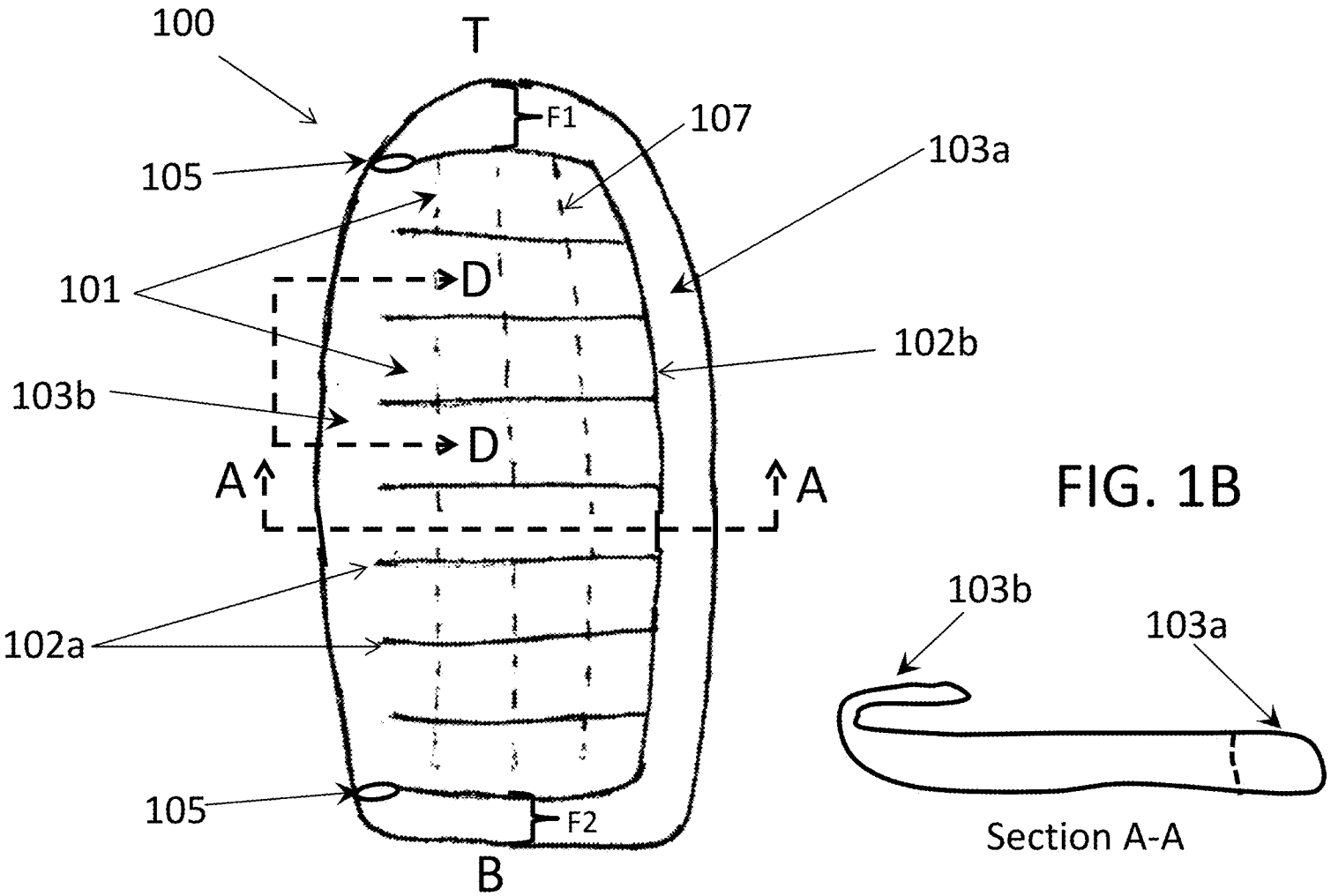
FIG. 1A illustrates a plan view of a sleeping bag according to an exemplary embodiment of the present inventive concept.
FIG. 1B illustrates the sleeping bag of FIG. 1A along lines A-A.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. Also, while describing the present general inventive concept, detailed descriptions about related well-known functions or configurations that may diminish the clarity of the points of the present general inventive concept are omitted.

It will be understood that although the terms "first" and "second" are used herein to describe various elements, these elements should not be limited by these terms. These terms are only used to distinguish one element from another element. Thus, a first element could be termed a second element, and similarly, a second element may be termed a first element without departing from the teachings of this disclosure.

Expressions such as "at least one of," when preceding a list of elements, modify the entire list of elements and do not modify the individual elements of the list.

All terms including descriptive or technical terms which are used herein should be construed as having meanings that are obvious to one of ordinary skill in the art. However, the terms may have different meanings according to an intention of one of ordinary skill in the art, case precedents, or the appearance of new technologies. Also, some terms may be arbitrarily selected by the applicant, and in this case, the meaning of the selected terms will be described in detail in the detailed description of the invention. Thus, the terms used herein have to be defined based on the meaning of the terms together with the description throughout the specification.

Also, when a part "includes" or "comprises" an element, unless there is a particular description contrary thereto, the part can further include other elements, not excluding the other elements.

Hereinafter, one or more exemplary embodiments of the present general inventive concept will be described in detail with reference to accompanying drawings.

Exemplary embodiments of the present general inventive concept are directed to a thermal insulating structure, such a sleeping bag, a comforter or a jacket, which includes adjustable warmth control features, such as a configuration to flexibly position insulating and heat retention material.

FIG. 1A illustrates a sleeping bag 100 according to an example embodiment of the present inventive concept. A top portion of the sleeping bag 100 will be referred to as "T" and a bottom portion of the sleeping bag will be referred to as "B." However, these references, together with terms left and right, are provided only to provide ease of understanding the overall inventive concept, and should not be limiting. The sleeping bag 100 can be formed of polyester, cotton or nylon, or any other type of material that will provide the intended purposes of providing a flexibly adjustable temperature control during a sleeping period.

The sleeping bag 100 according to this exemplary embodiment can include insulating channels 101 that can be formed by stitching baffles 102*a* widthwise (horizontally) across the sleeping bag 100, such that the insulating channels 101 are formed between the baffles 102*a* and also extend horizontally along a widthwise direction of the sleeping bag 100. A cross baffle 102*b* can be provided along one side (shown at a right side thereof in FIG. 1A) of the sleeping bag 100 and can extend from one end of a top most baffle 102*a* to one end of a bottom most baffle 102*a* to form a storage channel 103*a*. The cross baffle 102*b* is also illustrated to cross one end of each of the other baffles 102*a*, thus acting as a dividing line between the storage channels 103*a* and the channels 101.

As illustrated in FIG. 1A, the cross baffle 102*b*, and hence the storage channel 103*a*, can extend across the top T and the bottom B of the sleeping bag 100 to form a C-shape. In the storage channel 103*a* down feathers or other easily movable sleeping bag insulating filler material can be contained therein, thus acting as a storage location for the sleeping bag 100 insulating filler material. The storage channel 103*a* is separated from the insulating channels 101 by the cross baffle 102*b* and the upper most baffle 102*a* and lower most baffle 102*a*. As pointed out above, the cross baffle 102*b* crosses a same end of each of the baffles 102*a* to confine the area of each of the insulating channels 101 between adjacent baffles 102*a* and the cross baffle 102*b*.

As illustrated in FIG. 1A, since the baffles 102*a* do not extend fully to a side of the sleeping bag 100 (illustrated as the left side) opposite from the side in which the storage channel 103*a* is formed, a movement channel 103*b* is formed to extend from an end of the top most baffle 102*a* to an end of the bottom most baffle 102*a*. The movement channel 103*b* can be an open channel that extends along the whole side of the sleeping bag 100 from the top most baffle 102*a* to the bottom most baffle 102*a*. The length of the movement channel 103*b* is defined by choke points 105, as described in detail below.

The down feathers or other insulating filler material can be relocated from within the storage channel 103*a* to the individual insulating channels 101 by feeding the feathers through choke points 105. Although two choke points 105 are illustrated, alternatively, one choke point 105 may be provided at either the top T or the bottom B end of a movement channel 103*b*. In the exemplary embodiment where only one choke point 105 is implemented, the storage channel 103*a* and the movement channel 103*b* can be separated by the choke point 105 at, for example, the top, and can be separated at the bottom by extending the bottom most baffle 102*a* all the way to the side of the sleeping bag 100 (not illustrated).

Figure 2A:
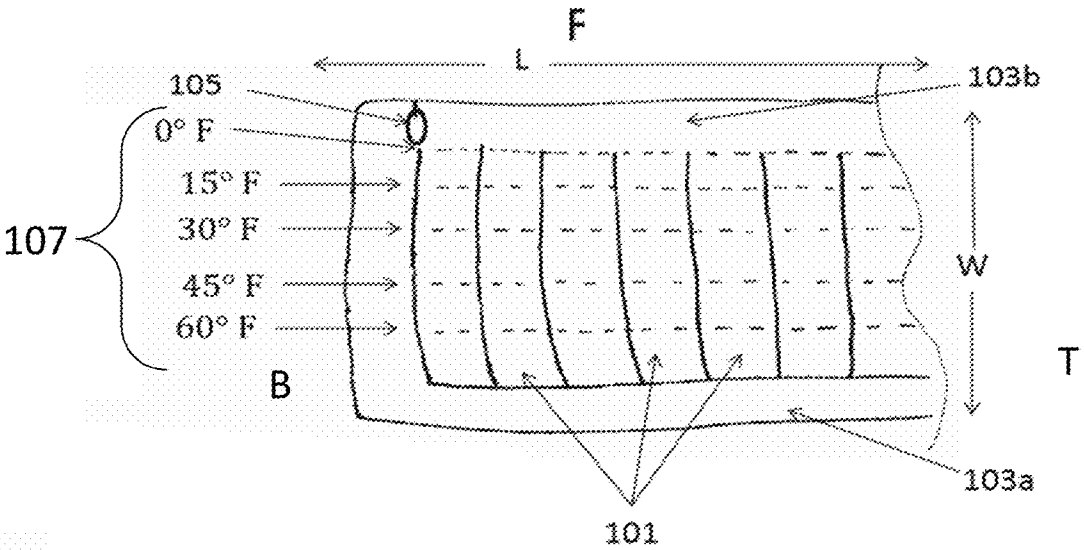
FIG. 2A illustrates the sleeping bag of FIG. 1A in an operating position.
Figure 2B:
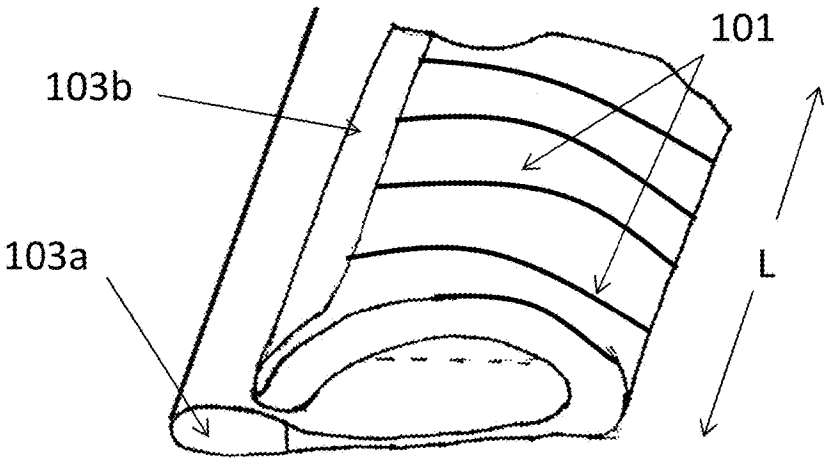
FIG. 2B illustrates the sleeping bag of FIG. 2A in a folded over operational position.
Figure 2C:
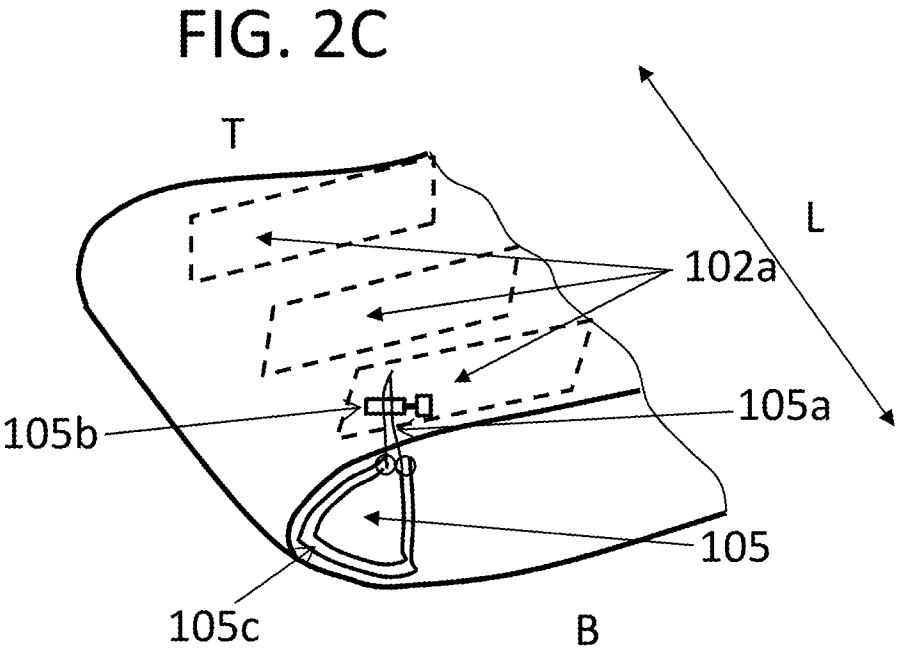
FIG. 2C illustrates a cross-sectional view of the sleeping bag of FIG. 2A.
Figure 2D:
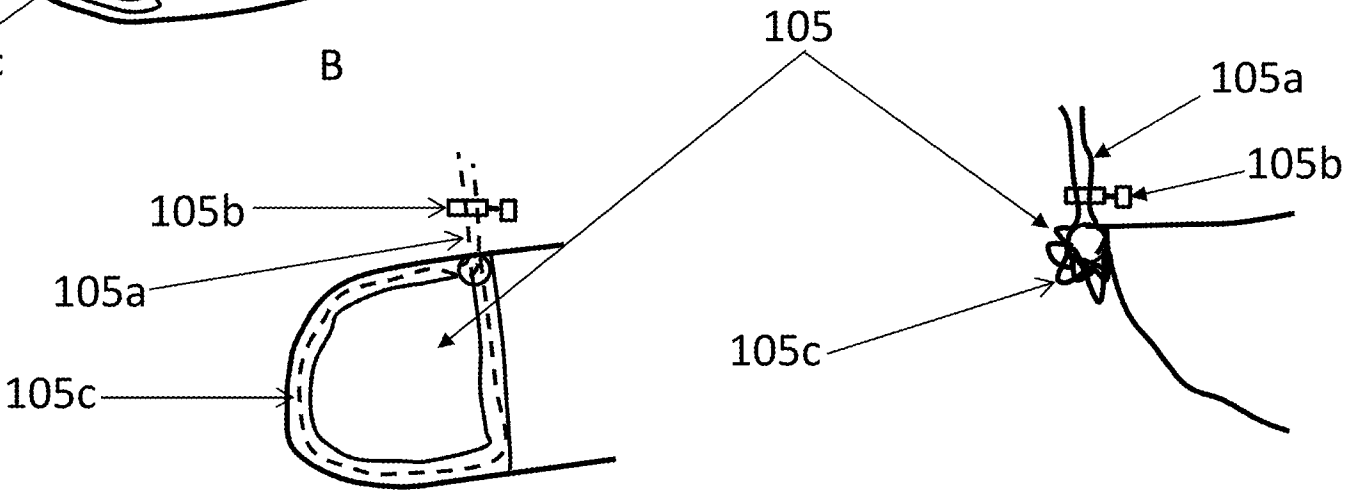
FIG. 2D illustrates a side view of the sleeping bag of FIG. 2C with a choke point in opened and closed positions.

As illustrated in FIG. 2C and FIG. 2D, the choke point(s) 105 can be formed of a tubular-shaped constriction controlled by a cord locking device extending outside the bag 100 so that a user can constrict the choke point(s) 105 and open the choke point(s) 105 as desired. Alternatively, the choke point(s) 105 can be formed with a flap inside the sleeping bag 100 which can be closed with a snap or a hook and loop system so that the choke points 105 can be opened or closed when desired. As a result of the formation of the choke point(s) 105, the down feathers can be fed through the choke point(s) 105 back and forth between the movement channel 103*b* and the storage channel 103*a* as desired, and can also be contained in any one of the desired channels until the user moves the sleeping bag filler material to adjust the amount of filler material required to be in the insulating channels 101 to keep the user at a comfortable temperature.

Referring back to FIG. 1A, the movement channel 103*b* can be fully open to each of the insulating channels 101 so that the down feathers, or other filler material, can be easily fed into any of the insulating channels 101 from the movement channel 103*b*. With this configuration, the down feathers can be selectively fed into any of the insulating channels 101 as desired. For example, if a user of the sleeping bag 100 tends to get cold feet when sleeping, the user can feed more down feathers into the lower insulating channels 101 closer to the bottom B where the user's feet are generally positioned during a sleep period. The user can also feed more down feathers into the upper insulating channels 101 to keep a user's upper body region and/or head warmer during a sleep period In an exemplary embodiment, the top T of the sleeping bag 100 indicated by F1 generally has a more rounded end and wider area to cover a user's head and provide down storage, as illustrated in FIG. 1A. This may be formed by stitching the top most baffle 102*a* a predetermined distance away from the top T end of the bag 100, thus forming the filler and insulation storage area F1 at the top of the bag 100. In a similar manner, the area at the bottom B end of the bag 100 may be stitched wider to provide an additional insulation storage area all with the intent of making the stored insulation readily available to the user.

FIG. 1B illustrates the sleeping bag 100 of FIG. 1A as viewed along a section A-A when the bag is opened and laid flat. In this figure the bottom B along the width of the sleeping bag 100 is illustrated. As illustrated in FIG. 1B, the storage channel 103*a* is to the right where down feathers are generally stored when less or no filler is required in the insulating area 101 of the sleeping bag 100. Although not illustrated in FIG. 1B, the storage channel 103*a* also extends across the top T and bottom B of the sleeping bag 100, as illustrated in FIG. 1A.

The movement channel 103*b* is illustrated in FIG. 1B as being flat since little or no filler material is presently located in the movement channel 103*b*. In other words, the down feathers or other insulating material that have been fed through the choke point(s) 105 and into the movement channel 103*b* from the storage channel 103*a* have been fed into the insulating channels 101 in a user's personally desired manner. At this point the sleeping bag 100 is ready to use simply by lying at one side of the sleeping bag 100 and folding the other side over the user, thus fully covering the user. Generally the user will rest on the storage channel 103*a* and the rightmost part of the insulating channel 101then fold the remainder of the insulating channels 101 over himself/herself for insulation. When the down movement channel 103*b* is empty it can be folded over to prevent movement of the down out of the insulating channels 101.

As will be discussed in more detail below, the sleeping bag 100 can have a zipper feature, buttons, or a hook and loop system at opposite sides thereof to keep the opposite sides of the sleeping bag 100 connected together, thus keeping the user covered and maintaining the body heat of the user within the confines of the sleeping bag 100.

Figure 1D:
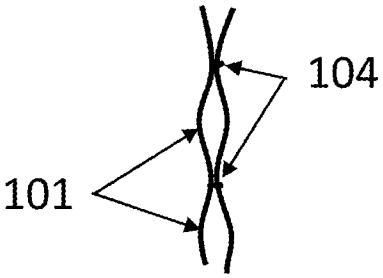
FIG. 1D illustrates a cross-sectional view of part of a jacket, according to another exemplary embodiment of the present inventive concept.
Figure 1C:
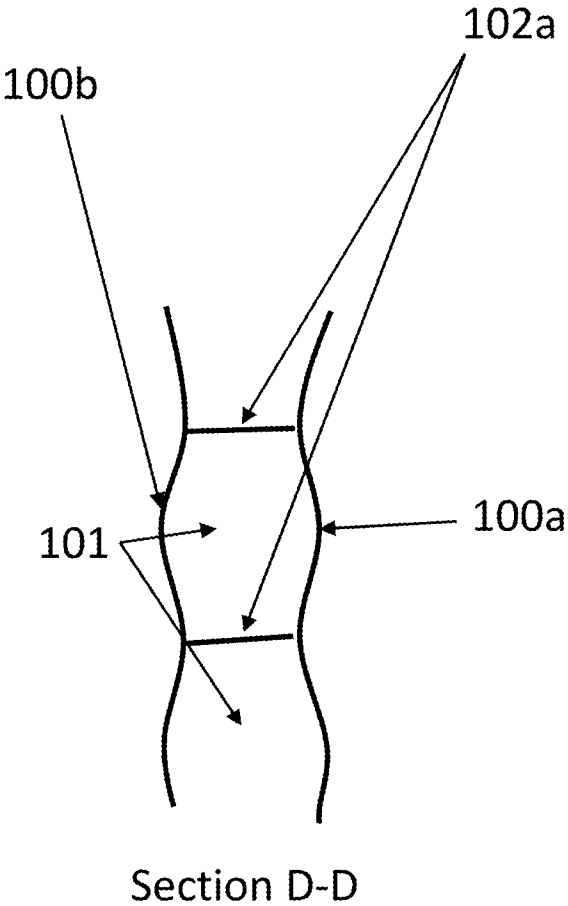
FIG. 1C illustrates the sleeping bag of FIG. 1A along the lines D-D.

FIG. 1C illustrates a view of the sleeping bag 100 of FIG. 1A along a section D-D as illustrated in FIG. 1A. Here the baffles 102*a* are illustrated as being stitched between a front portion 100*a* of the sleeping bag 100 and a back portion 100*b* of the sleeping bag 100 to form the insulating channels 101. The front portion 100*a* and back portion 100*b*, together with the top, bottom and opposite sides together form the entire shell of the sleeping bag 100. This structure can also apply to comforters according to other exemplary embodiments of the present inventive concept.

FIG. 1D illustrates a partial shell of a coat/jacket to be worn by a user, including stitch lines 104 that form insulating channels 101 where down feathers can be disposed for insulation. In contrast with the baffles 102*a* in FIG. 1C, the stitch lines 104 according to this exemplary embodiment tend to let some heat escape since there are no down feathers at the stitch points 104. Choke points 105 can be positioned at predetermined locations along the stitch points 104 to allow down feathers to be moved between each of the insulating channels 101.

FIG. 2A illustrates a top view of the sleeping bag 100 of FIG. 1A extending lengthwise (L) from the top T to the bottom B. As the down feathers or other insulating material are moved from the storage channel 103*a* through the choke point(s) 105 and into the movement channel 103*b*, this insulation material can then be dispersed from the movement channel 103*b* into any of the insulating channels 101 as desired.

As illustrated in FIG. 2A, according to an exemplary embodiment, temperature indication lines 107 can be formed along the length of the sleeping bag 100 from the top T to the bottom B to guide the user as to how much to fill each insulating channel 101 depending on the expected environmental temperature during a sleeping period. For example, if a user intends to sleep on a snowy mountain at a temperature between 15° F. to 30° F., the user can fill each of the insulating channels 101 to a point between the 15° F. to 30° F. indication lines 107. If a user intends to sleep at a location that is expected to have a temperature of 60° F., the user can fill each of the insulating channels 101 up to the 60° F. indication line 107. In addition, a user can fill the lower channels 101 to a different amount than the upper insulating channels 101 depending on whether the user's feet or head get colder or hotter during sleep.

The temperature indication lines 107 can be formed at any desired temperature indication intervals to indicate environmental temperatures in which the sleeping bag 100 will keep the user at a comfortable temperature during use. As illustrated, in below freezing weather, such as 0° F., a user can fill each of the insulating channels 101 all the way up to the 0° F. temperature indication line 107. To personalize the warmth for a user, a user who sleeps warm may choose to fill each of the insulating channels 101 to the 60° F. line, knowing that the forecasted temperature is expected to be about 45° F., thus providing a cooler internal temperature of the sleeping bag 100. Similarly, a user who sleeps cold may choose to fill each of the insulating channels 101 to the 15° F. line, even though the forecasted temperature is expected to be about 30° F., thus providing a warmer internal temperature of the sleeping bag 100. The temperature indication lines 107 are formed on the outside of the sleeping bag 100, and do not interfere with the flow of the insulating material inside the insulating channels 101. Once the insulating material is filled to the desired temperature indication line (or marks) 107, this insulating material can be disbursed throughout the insulating channels 101 to provide the desired sleeping temperature.

The temperature indication lines 107 can alternatively be ribbons or marks at one section of the sleeping bag 100 to allow a user to estimate how much down needs to be in each of the insulating channels 101 by visual extrapolation across the length of the bag FIG. 2B illustrates one of many adjustable states in which the sleeping bag 100 can be placed for use. Here, many of the down feathers have been removed from the storage channel 103*a* and mostly distributed among the insulating channels 101. Once the down feathers are pushed through the choke point(s) 105 and into the movement channel 103*b*, the down feathers can then be distributed among the insulating channels 101*a* s desired, as pointed out above. Also shown in FIG. 2B is the configuration where the movement channel 103*b* has little to no down feathers remaining therein, and at this point can be folded over to trap down from moving. This principle can be used as needed to prevent down migration.

FIG. 2C illustrates a cross-sectional view of the sleeping bag of FIG. 2A, with a choke point 105 being formed with a cord 105*a* and cord lock 105*b*. Here the cord 105*a* is fed through a small tubular channel 105*c* that extends along a perimeter of the choke point 105. The baffles 102*a* extend width-wise W across the bag 100 and stop short to allow the movement channel 103*b* to be formed.

FIG. 2D illustrates a bottom B view of the sleeping bag of FIG. 2C with a choke point 105 in the open position (left diagram) and in the closed position (right diagram). The tubular channel 105*c* of the choke point 105 becomes very small in the closed position such that down feathers or other insulating material cannot pass through. At this position, the tubular channel 105*c* is shriveled up.

Figures 3A, 3B, 3C:
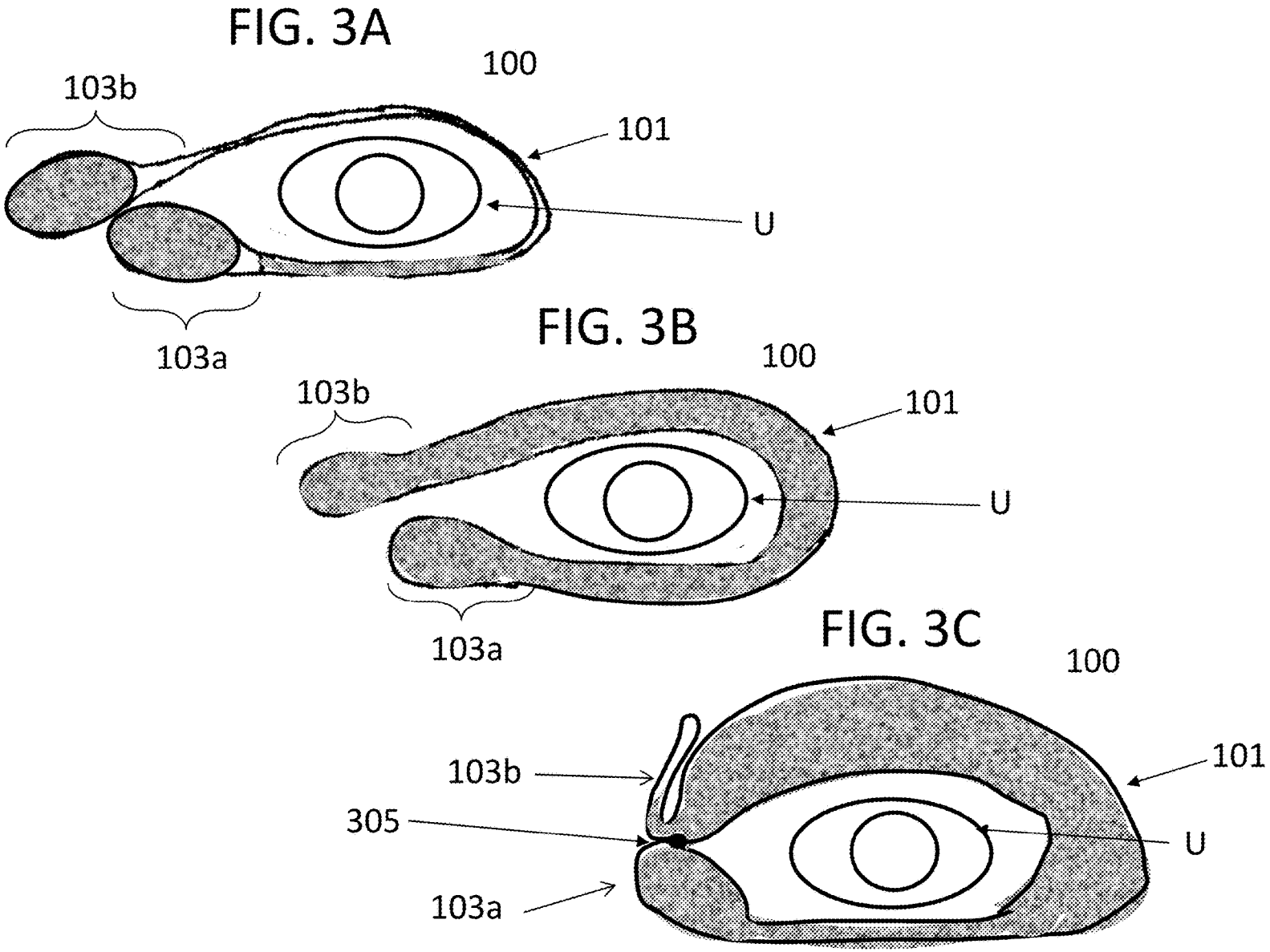
FIG. 3A illustrates the sleeping bag of FIGS. 1A and 2A operational in warm temperatures.
FIG. 3B illustrates the sleeping bag of FIGS. 1A and 2A operational in cool temperatures.
FIG. 3C illustrates the sleeping bag of FIGS. 1A and 2A operational in cold temperatures.

FIG. 3A illustrates a state in which the sleeping bag 100 has few down feathers in the insulating channels 101, and the down storage and movement channels 103*a* and 103*b*, respectively, are stuffed full of feathers, thus leaving the insulating channels 101 empty on the top and bottom of the user. This is considered a warm environment sleeping configuration, since in this state little to no feathers are required to keep the user warm during a warm sleeping period.

FIG. 3B illustrates a state in which the sleeping bag 100 has about half of down feathers dispersed within the insulating channels 101. This is considered a cool sleeping configuration where the environment in which a user (U) will sleep is cool, but not cold or freezing. In this configuration the down storage channel 103*a* and movement channel 103*b* are half full of down feathers and the insulating channels 101 are filled to a medium thickness. Also illustrated is that some of the insulating down feathers are shifted on top of the user and some underneath the user since sleeping on the down feathers reduces the insulation value, thus reducing the warmth of the bag further.

FIG. 3C illustrates a configuration in which the sleeping bag 100 has a maximum number of down feathers within the insulating channels 101 on top of the user and few underneath. This is considered a cold environment sleeping configuration. FIG. 3C illustrates where the down movement channel 103*b* is nearly empty of down feathers and is folded back and held with hook and loop to trap down over the user and prevent it from moving into the down movement channel 103*b*, while the insulating channels 101 are filled to provide a maximum loft. The storage channel 103*a* is provided with just enough down feathers to provide insulation to the user's left side and to provide enough down feathers in the filler area F1 (see FIG. 1A) to cover the users head completely. Note that this configuration is ideal for sleeping on either of the user's sides rather than lying on one's back as in a typical mummy bag. As described above, these various configurations take advantage of the use of the temperature indication lines 107 to adjust the down fill in the insulating channels 101 to achieve the proper down thickness for the temperature desired. Hook and loop strips 305 (or a zipper, buttons, snaps) can be provided at an outside surface of both the storage channel 103*a* and the movement channel 103*b* to fasten the opposite sides of the sleeping bag 100 together, thus keeping the body heat of the user within the sleeping bag 100. Here the end of the sleeping bag 100 where the movement channel 103*b* is located, and the opposite end of the sleeping bag 100 where the storage channel 103*a* is located, can be fastened together with a button and button-hole configuration 305, a hook and loop type configuration, or a zipper configuration. These configurations are described in more detail with reference to FIGS. 6B and 6C.

Figure 4A:
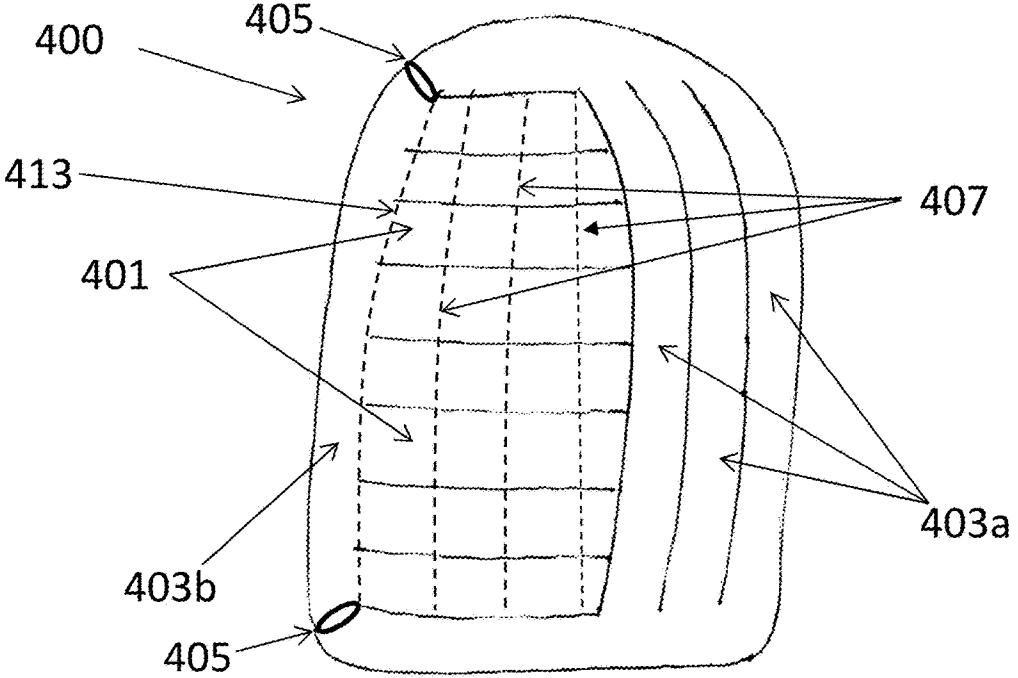
FIG. 4A illustrates a plan view of a sleeping bag according to another exemplary embodiment of the present inventive concept.

FIG. 4A illustrates a sleeping bag 400 in accordance with another exemplary embodiment of the present inventive concept. In this exemplary embodiment, there can be three storage channels 403*a* in which to store down feathers, one movement channel 403*b*, and several insulating channels 401 formed in a main area 413. Here the three storage channels 403*a* provide a configuration that is wider to contain enough down feathers to fill all of the insulating channels 401 when desired. There can alternatively be more or less than three storage channels 403*a*.

Also provided can be a choke point 405 at the top of the movement channel 403*b* and a choke point 405 at the bottom of the movement channel 403*b* to prevent down feathers from dispersing out from the insulating channels 401 and back to the storage channels 403*a* during a cold sleeping environment.

The three storage channels 403*a* also distribute the down feathers evenly under a user for a warm sleeping environment when sleeping on the down feathers results in compressing the feathers and reducing the insulating performance. The choke points 405 also prevent the down feathers from dispersing around from under the user to the insulating channels 401 positioned over the user. It is to be noted that the configuration of, and communication between, the insulating channels 401, the movement channel 403*b* and the storage channels 403*a* are not limited to the above described arrangement, and can be configured in alternative ways that will provide the intended purposes of the overall inventive concept as described herein. For example, the configuration of the insulating channels 401, the movement channel 403*b* and the storage channels 403*a* can be rearranged in other configurations which will enable flexible movement of down feathers or other insulating filler material throughout a sleeping bag to provide adjustable warmth control throughout the sleeping bag 400, and to provide for a quick adjustment of the temperature control.

Figure 4B:
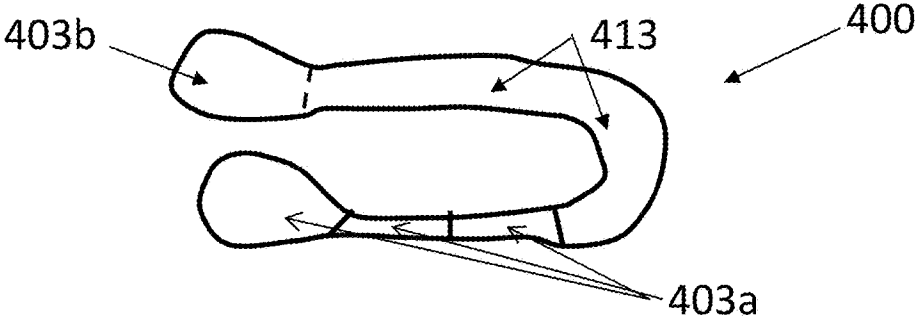
FIG. 4B illustrates the sleeping bag of FIG. 4A in an operating configuration.

Referring to FIG. 4B, if the user decides to use the three storage channels 403*a* of FIG. 4A as a bed/resting pad, the user's body will compress the three storage channels 403*a* full of down feathers, making this portion of the sleeping bag 400 cooler. This also allows the user to move the down feathers around to different parts of the insulating channels 401 in the main area 413 by pushing the down feathers through choke points 405 and into the movement channel 403*b*, where the down feathers can then be distributed into the insulating channels 401 to a desired temperature level using the temperature indication lines 407. Some down feathers can be left in the movement channel 403*b* to allow the user to quickly increase the insulation in the insulating channels 401 during a sleeping period by sweeping the down feathers (or other insulation material) from the movement channel 403*b* into the insulating channels 401 with the swipe of an arm as the temperature varies during the sleeping period. Alternatively, if the user is too warm, down feathers can also be swept from the insulating channels 401 into the movement channel 403*b* with an arm movement or by patting the down feathers out of select ones of the insulating channels 401.

FIG. 4B also illustrates where the insulating channels 401 in the main area 413 contain a large portion of the down feathers as needed to match the expected temperature conditions, and the storage channels 403*a* contain the remainder of the down insulation, which, while not contributing significantly to keeping the user warm due to being compressed, provides some insulation where the user is not lying on it, which adds comfort.

Figure 4C:
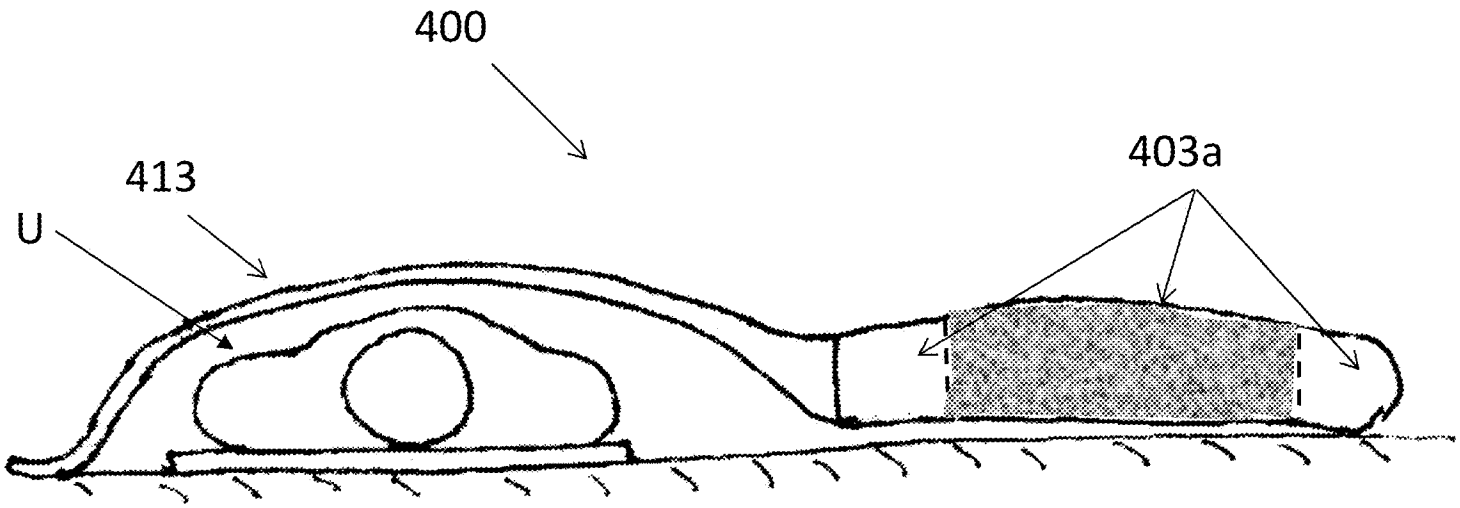
FIG. 4C illustrates the sleeping bag of FIG. 4A in another operating configuration.

FIG. 4C illustrates another configuration of the sleeping bag 400 where the down feathers can be stored in one or more of the storage channels 403*a* among the three storage channels 403*a*. Here the main area 413 including the insulating channels 401 (not illustrated due to angle) has no down feathers disbursed therein, and is used as a light covering for a user. In this configuration all of the down feathers are stored among the three storage channels 403*a* and the sleeping bag 400 would be used in warm weather and where little insulation is required, and when the user has a separate sleeping pad in which to rest on, since sleeping on the storage area 403*a* may result in more warmth than desired.

Figure 5A:
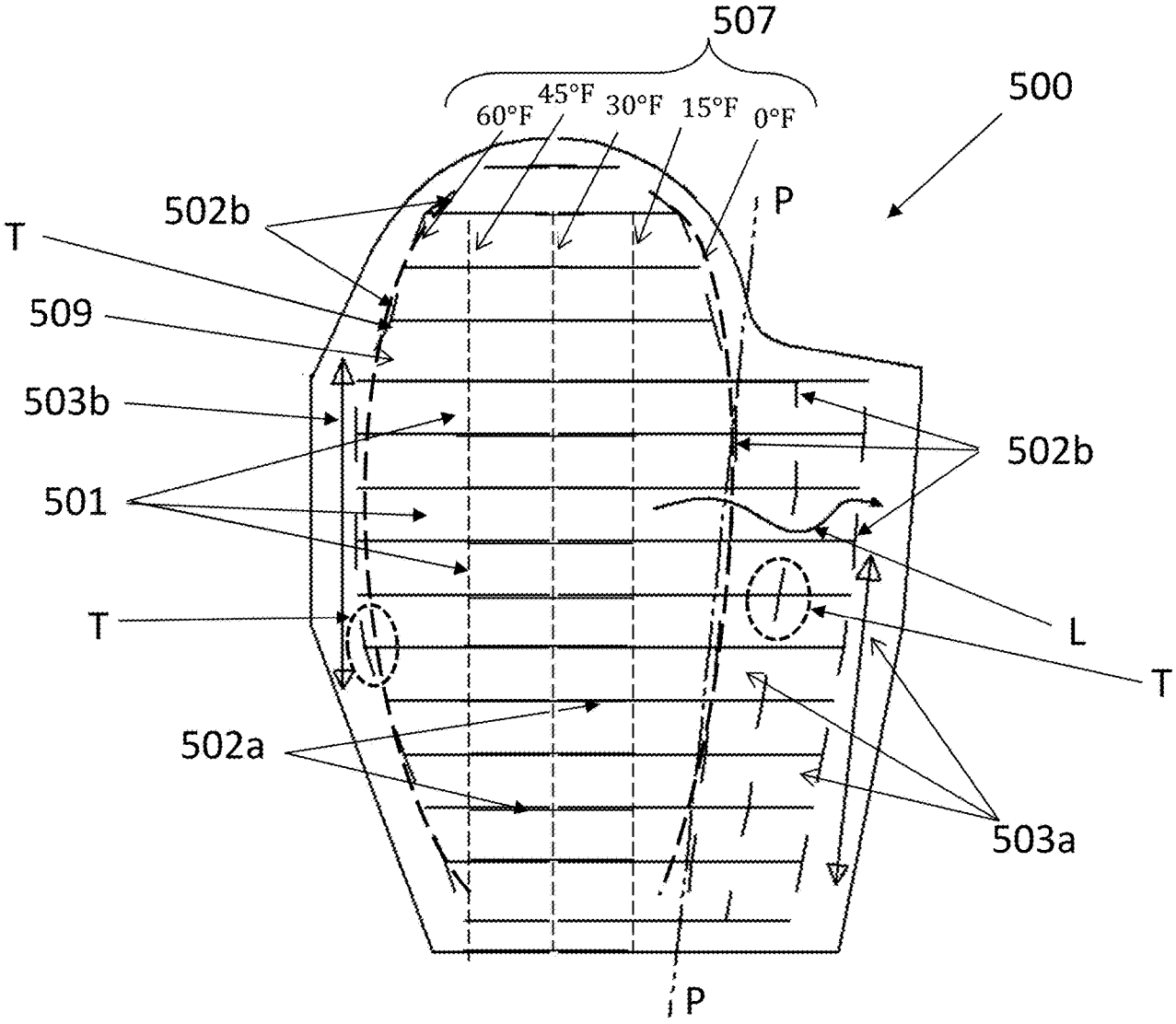
FIG. 5A illustrates a plan view of a sleeping bag according to still another exemplary embodiment of the present inventive concept.

FIG. 5A illustrates a sleeping bag 500 according to another exemplary embodiment of the present inventive concept. In this exemplary embodiment, insulating channels 501 extend across almost the entire sleeping bag 500 and are integrated with three storage channels 503*a*. It is to be noted that the number of storage channels 503*a* can be varied to be fewer in number while wider in size, or to be more in number and thinner in size. It is to be noted that this exemplary embodiment also relates to comforters and quilts.

The insulating channels 501 extend into the storage channels 503*a* and are formed by sewing first baffles 502*a* widthwise across the sleeping bag 500 in a main area 509 (confined within the dashed lines) and into the storage channels 503*a*. The main area 509 is the area that encompasses the portion of the insulating channels 501 between the storage channels 503*a* and the movement channel 503*b*, and from the top of the sleeping bag 500 to the bottom of the sleeping bag 500. The main area 509 functions as the area in which the insulating channels 501 provide the adjustable insulation to keep a user's body at a comfortable temperature during varying environmental temperatures.

A first set of cross baffles 502*b* can be sewn lengthwise from the top of the sleeping bag 500 to the bottom of the sleeping bag 500 along one side (right side in FIG. 5A) to form three storage channels 503*a*. This first set of cross baffles 502*b* can be sewn vertically across the baffles 502*a* in sections to create T baffles (see dotted circle). The T baffles are configured to form labyrinths "L" along a portion of the insulating channels 501 (storage channels 503*a*). The insulating channels 501 and storage channels 503*a* are integrated in that the flow therebetween exists, but is partially obstructed by the cross baffles 503*a*.

The labyrinths L make movement of the down feather more difficult than in the unobstructed portion of the insulating channels 501, thus assisting in retaining the down feathers in the storage channels 503*a* until a user swipes an arm/hand across the labyrinths L, or pats the labyrinths L, which will force the down feathers to move in the direction of the swiping or away from the patting. Furthermore, any down feathers disbursed outside the storage channels 503*a* into the insulating channels 501 will stay outside the storage channels 503*a* as a result of the T baffles forming the labyrinths L, until the down feathers are intentionally moved back into the storage channels 503*a* with a swiping or patting of the down feathers out of the insulating channels 501. For example, the storage channels 503*a* (disposed to the right of a phantom line "P") will trap any down feathers that are moved into this area by a swiping, patting, or pushing of the down feathers from the main area 509 of the sleeping bag 500, and any down feathers not swiped or patted into the storage area(s) 503*a* will remain in the insulating channels 501 due to being blocked by the T baffles forming the labyrinths L.

A movement channel 503*b* can be formed at a side of the sleeping bag 500 opposite the side where the storage channels 503*a* are formed (provided to the left in this diagram). Similar to the formation of the storage channels 503*a*, the movement channel 503*b* can be integrated with the insulating channels 501 by sewing a second cross baffle 502*b* in sections across alternate ones of the baffles 502*a* to create T baffles, where the flow from the insulating channels 501 to the movement channel 503*b* is open but partially obstructed by the T baffles.

With the configuration of the sleeping bag 500 in FIG. 5A, a user can disburse the down feathers throughout the insulating channels 501 in the main area 509, and can spread some or all of the down features into the storage channels 503*a*, and/or can spread some of the down feathers into the movement channel 503*b*. By spreading down feathers into the movement channel 503*b*, a user can then disburse the down feathers into any desired number of the insulating channels 501, thus customizing the sleeping bag to have either more down feathers at the upper portion of the bag 500 for more upper body insulation, or to have more down feathers at the middle portion of the bag 500 for more mid-body insulation, or to have more feathers at the bottom portion of the bag 500 for more leg/feet insulation. In other words, by moving down feathers into the movement channel 503*b*, the user can then disburse the down feathers up and down along the side of the sleeping bag 500 from the top of the bag 500 to the bottom of the bag 500 and into any of the insulating channels 501 as desired, for the user's body type comfort level. Note that by folding the storage channels 503*a* and the down movement channel 503*b* over and attaching them using hook and loop or buttons, the down can be trapped and prevented from moving out of the insulating channels 501.

In addition to selectively choosing which insulating channels 501 to fill with down feathers, a user can also spread the down feathers into each of the insulating channels 501 evenly and to a desired amount so that the feathers can be filled into each of the insulating channels 501 to an amount that matches the expected environmental temperature during a sleeping period. For example, The sleeping bag 500 can include a plurality of temperature indication lines 507 extending from the top to the bottom of the bag 500. These temperature indication lines 507 are separated by an amount of space that has been determined to contain an amount of down feathers or other insulting material to provide a certain degree of warmth within the insulating channels 501. Hence, a user can fill each of the insulating channels 501 to the first temperature indication line 507, which indicates how much down feather fill is required for comfort when the sleeping temperature is expected to be about 60° F., to the second temperature indication line 507, which indicates how much down feather fill is required for comfort when the sleeping temperature is expected to be about 45° F., to a third indication line 507, which indicates how much down feather fill required for comfort when the sleeping temperature is expected to be about 30° F., etc.

The sleeping bag 500 according to this exemplary embodiment is designed to allow a user to move down feathers along the sides thereof from the top to the bottom, to move down feathers into any desired insulating channels 501 from the top to the bottom of the bag 500 for personalized comfort levels, and/or into each of the insulating channels 501 to an amount that matches the expected environmental temperature during a sleeping period, and into storage channels 503*a* to a certain degree in which some or all of the down feathers are not presently needed, or may be desired to provide a certain amount of padding for the user's back while lying thereon.

Figure 5B:
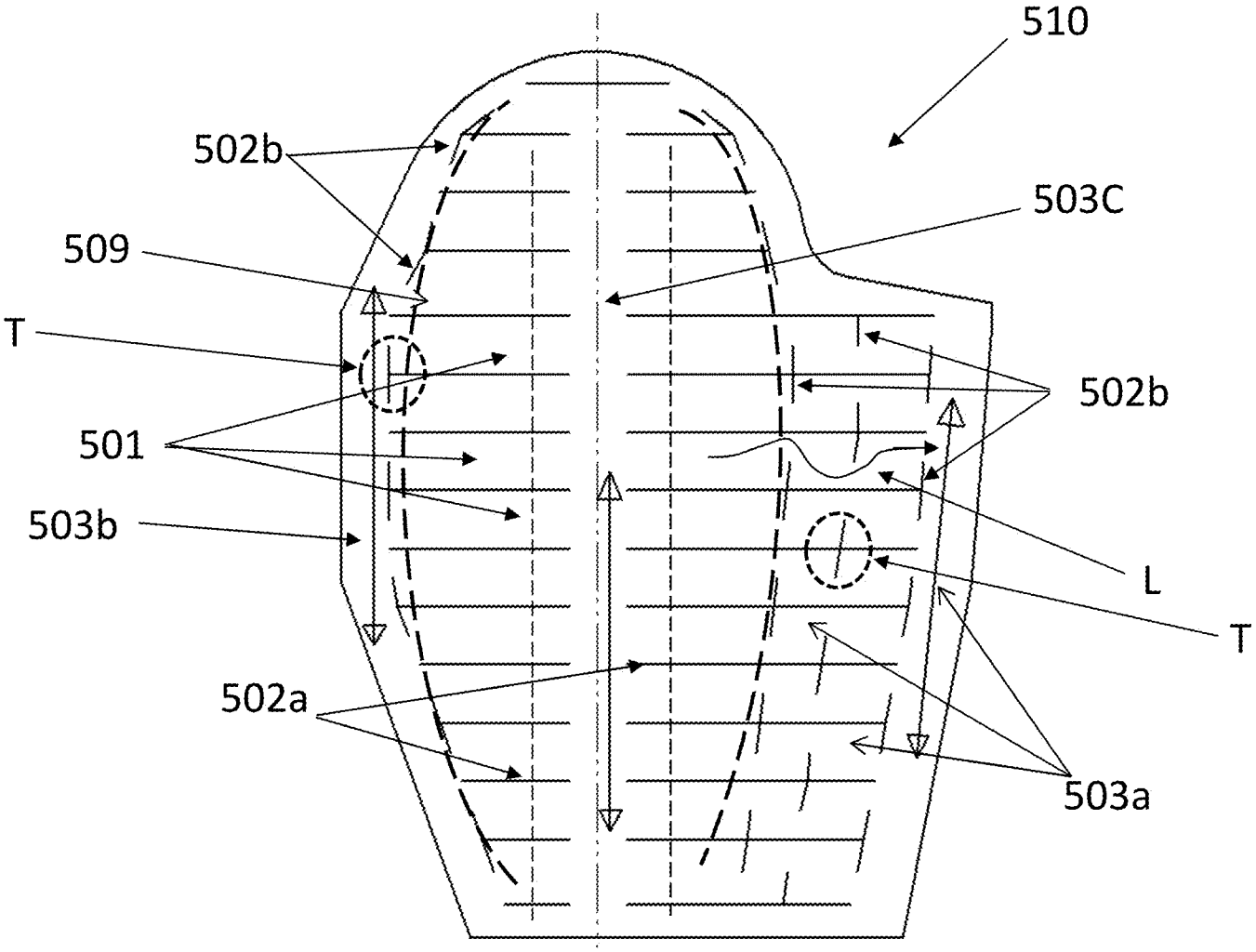
FIG. 5B illustrates a plan view of a sleeping bag according to still another exemplary embodiment of the present inventive concept.

FIG. 5B illustrates a sleeping bag 510 according to still another exemplary embodiment of the present inventive concept. In this exemplary embodiment, similar to the exemplary embodiment of FIG. 5A, insulating channels 501 extend across almost the entire sleeping bag 500 and are integrated with three storage channels 503*a* so that a flow exists therebetween. It is to be noted that the number of storage channels 503*a* can be varied to be fewer in number while wider in size, or more in number while thinner in size. It is also to be noted that this exemplary embodiment can alternatively be applied as a quilt.

The insulating channels 501 in this exemplary embodiment, similar to the exemplary embodiment of FIG. 5A, are formed by sewing baffles 502*a* widthwise across the sleeping bag 500. The main area 509 in this exemplary embodiment is the same as that of the exemplary embodiment of FIG. 5A. A first set of cross baffles 502*b* can be sewn lengthwise from the top of the sleeping bag 500 to the bottom of the sleeping bag 500 to form the three storage channels 503*a*. The storage channels 503*a* are integrated with the portion of the insulating channels 501 disposed in the main area 509, similar to the exemplary embodiment of FIG. 5A.

This first set of cross baffles 502*b* can be sewn vertically across the baffles 502*a* in sections to create T baffles (enclosed in a dotted circle). Further, adjacent first cross baffles 502*b* cross alternate baffles 502*a*, which form T baffles. The formation of the plurality of first cross baffles 502*b* form labyrinths "L" along a portion of the insulating channels 501, thus forming the storage channels 503*a*, similar to the exemplary embodiment of FIG. 5A.

With this configuration, any down feathers disbursed outside the labyrinths L, for example, into the insulating channels 501 in the main area 509, will stay outside the labyrinths L until intentionally moved with a swiping or patting of the down feathers back into the storage channels 503*a*. For example, the storage channels 503*a* will trap any down feathers forced therein by a swiping or patting of the down feathers from the main area 509 of the bag 510, and any down feathers not swiped or patted into the storage channels 503*a* will remain in the main area 509 of the insulating channels 501 due to being blocked by the T baffles which form the labyrinths L.

Also similar to the exemplary embodiment of FIG. 5A, a movement channel 503*b* can be formed at a side of the sleeping bag 500 opposite the side where the storage channels 503*a* are formed. Similar to the formation of the storage channels 503*a*, the movement channel 503*b* can be integrated with the insulating channels 501 by sewing a second cross baffle 502*b* in sections across the baffles 502*a* to create T baffles (dotted circle). With this exemplary embodiment, a user can disburse the down feathers throughout the insulating channels 501 in the main area 509, can spread some or all of the down features into the storage channels 503*a*, and/or can spread some of the down feathers into the movement channel 503*b*. By spreading down feathers into the movement channel 503*b*, a user can then disburse the down feathers into any desired insulating channels 501, thus customizing the sleeping bag to have more down feathers at the upper portion of the bag 500 for more upper body insulation, or to have more down feathers at the middle portion of the bag 500 for more mid-body insulation, or to have more feathers at the bottom portion of the bag 500 for more leg/feet insulation. In other words, by moving down feathers into the movement channel 503*b*, the user can then disburse the down feathers from the top of the bag 500 to the bottom of the bag 500 and into any of the insulating channels as desired for the user's personal body type comfort level.

Furthermore, a user can also spread the down feathers into each of the insulating channels 501 evenly and to a desired amount so that the feathers can be filled into each of the insulating channels 501 to an extent that matches the expected environmental temperature during a sleeping period. Although not illustrated in the exemplary embodiment of FIG. 5B, temperature indication lines 507 can be provided in this embodiment in a similar manner as those illustrated in the exemplary embodiment of FIG. 5A. For example, a user can fill each of the insulating channels 501 to a first temperature indication line 507, which indicates how much down feather fill is required for comfort when the sleeping temperature is expected to be about 60° F., to the second temperature indication line 507, which indicates how much down feather fill is required for comfort when the sleeping temperature is expected to be about 45° F., to a third indication line 507, which indicates how much down feather fill required for comfort when the sleeping temperature is expected to be about 30° F., etc.

In addition to the storage channels 503*a* and the movement channel 503*b*, the sleeping bag according to this exemplary embodiment may also include a second movement channel 503*c*. This second movement channel 503*c* can provide an additional means for moving down feathers that are disposed in the insulating channels 501 up toward the top of the sleeping bag 510 or down toward the bottom of the sleeping bag 510. This additional movement channel 503*c* provides a more speedy process of moving down feathers between the different insulating channels 501, as well as moving more down feathers into the insulating channels 501 or out of the insulating channels 501 when a user requires a quick process of adjusting the insulation comfort level during a quick drop in temperature or a quick rise in temperature during a sleeping period.

The sleeping bag 510 according to this exemplary embodiment is designed to allow a user to move down feathers along the sides thereof from the top to the bottom, into any desired insulating channels 501 between the top and bottom of the bag 510 for personalized comfort levels, into each of the insulating channels 501 to a degree that matches the expected environmental temperature during a sleeping period, and into storage channels 503*a* to a certain degree in which some or all of the down feathers are not presently needed or can be used to provide a desired padding for resting thereon. Additionally, the sleeping bag 510 according to this exemplary embodiment also includes a movement channel 503*c* disposed substantially in a middle of the main area 509 for quicker movement of the down feathers when environmental temperatures change rapidly and leave a user little time for adjusting the down feathers to obtain a comfortable sleeping temperature within the sleeping bag 510.

Figure 5C:
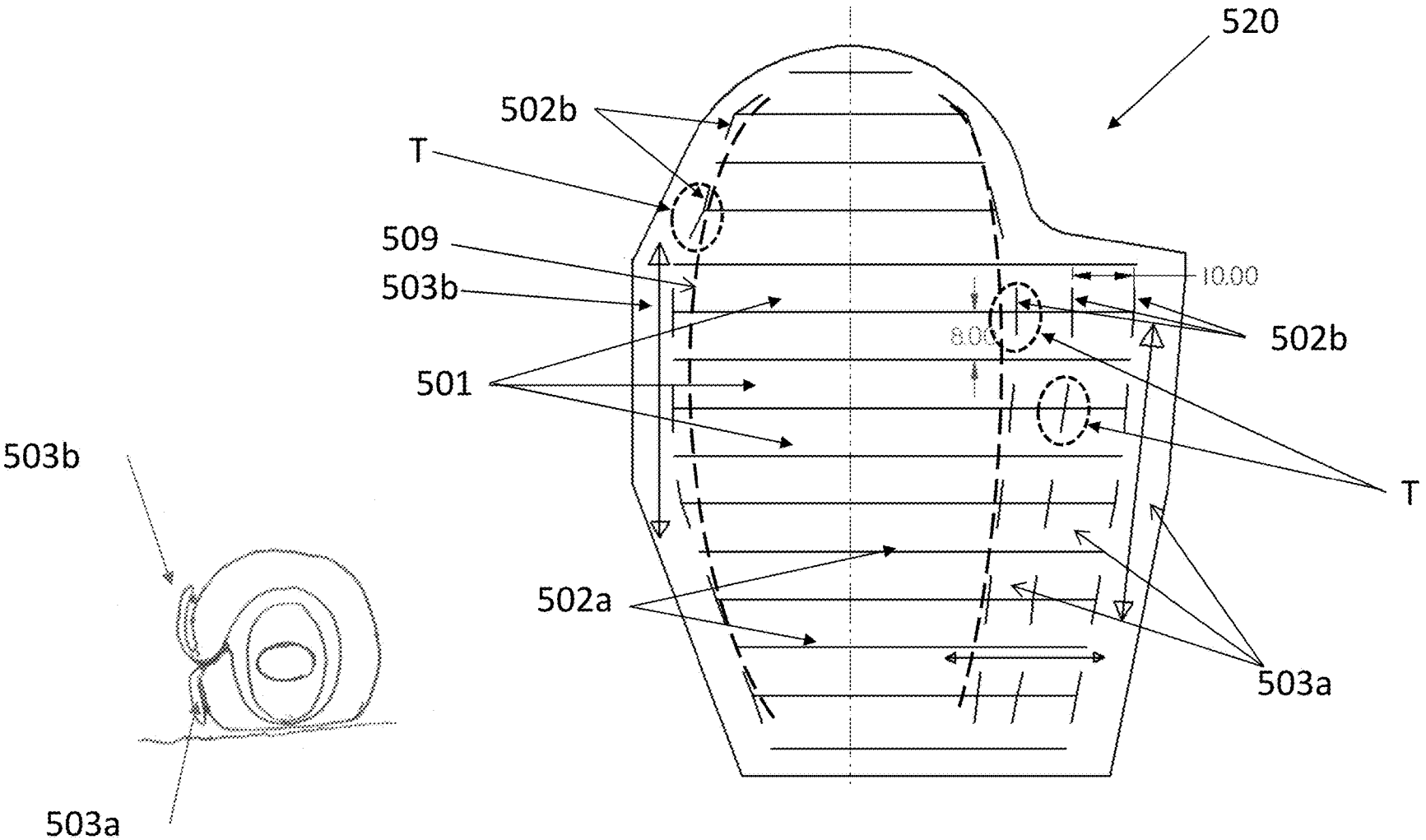
FIG. 5C illustrates a plan view of a sleeping bag according to still another exemplary embodiment of the present inventive concept.

FIG. 5C illustrates still another exemplary embodiment of the present inventive concept. In this exemplary embodiment, a movement channel 503*b* can be configured the same as the movement channel 503*b* in the exemplary embodiment of FIG. 5A and FIG. 5B, and insulating channels 501 can extend horizontally across the sleeping bag 520 while being integrated with the movement channel 503*b* and three storage channels 503*a*, also configured the same as that provided in the exemplary embodiment of FIG. 5A. The insulating channels 501 in this exemplary embodiment are also defined by horizontal baffles 502*a*, which are sewn into the shell of the sleeping bag 520 to bring together front and back portions of the sleeping bag 520 and form each of the separate adjacent insulating channels 501.

However, in this exemplary embodiment a first set of cross baffles 502*b* are formed differently from the first set of cross baffles 502*b* illustrated in the exemplary embodiments of FIGS. 5A and 5B. For instance, all of the first cross baffles 502*b* in FIG. 5C cross every other one of the same baffles 502*a* to form broken vertical lines, thus interrupting the insulating channels 501 to form the storage channels 503*a*. In other words, the first cross baffles 502*b* are aligned with respect to each other so that every other baffle 502*a* can include a row of cross-baffle stitches 502*b* separated from each other by a predetermined distance. Hence, each alternate baffle 502*a* includes a row of T baffles (see dotted circle).

In this exemplary embodiment, the first set of cross baffles 502*b* do not create a labyrinth L, but instead form a partial obstruction of flow of down feathers across each of the insulating channels 501, which creates the storage channels 503*a*. Since the partial obstruction created by the cross baffles 502*b* aligned in a row along every other baffle 502*a* do not form labyrinths L, the movement of down feathers from the insulating channels 501 located in the main area 509 to the storage channels 503*a* has a more direct path to travel, and therefore the movement of the down feathers in this exemplary embodiment is easier to accomplish than in the embodiments where labyrinths L are formed.

The distance between each of the first cross baffles 502*b* along the baffles 502*a* can be configured to be a predetermined distance apart, and can be slightly farther apart than the distance between adjacent baffles 502*a*. For example, the distance between each of the cross baffles 502*b* along a baffle 502*a* can be 10 inches apart while the distance between each of the baffles 502*a* can be 8 inches apart. This configuration provides for the down feathers to remain trapped within the storage channels 503*a* until intentionally disbursed into the insulating channels 501 in the main area 509 by swiping or patting the down feathers out of the storage channels 503*a* and into the insulating channels 501.

Similar to the exemplary embodiments of FIGS. 5A and 5B, a user can disburse the down feathers throughout the insulating channels 501 in the main area 509, can spread some or all of the down features into the storage channels 503*a*, and/or can spread some of the down feathers into the movement channel 503*b*. By spreading down feathers into the movement channel 503*b*, a user can then disburse the down feathers into any desired insulating channels 501, thus customizing the sleeping bag to have more down feathers at the upper portion of the bag 520 for more upper body insulation, or to have more down feathers at the middle portion of the bag 520 for more mid-body insulation, or to have more feathers at the bottom portion of the bag 520 for more leg/feet insulation. In other words, by moving down feathers into the movement channel 503*b*, the user can then disburse the down feathers from the top of the bag 520 to the bottom of the bag 520 as desired to obtain the user's personal body type comfort level.

Furthermore, a user can also spread the down feathers into each of the insulating channels 501 evenly and to a desired amount so that the feathers can be filled into each of the insulating channels 501 to match the expected environmental temperature during a sleeping period. Although not illustrated in FIG. 5C, the sleeping bag 520 according to this exemplary embodiment can also include temperature indication lines or markers 507, as illustrated in FIGS. 5A and 5B. Therefore, similar to the exemplary embodiments of FIGS. 5A and 5B, a user can fill each of the insulating channels 501 to the first temperature indication line 507, which indicates how much down feather fill is required for comfort when the sleeping temperature is expected to be about 60° F., to the second temperature indication line 507, which indicates how much down feather fill is required for comfort when the sleeping temperature is expected to be about 45° F., to a third indication line 507, which indicates how much down feather fill required for comfort when the sleeping temperature is expected to be about 30° F., etc.

Figure 5D:
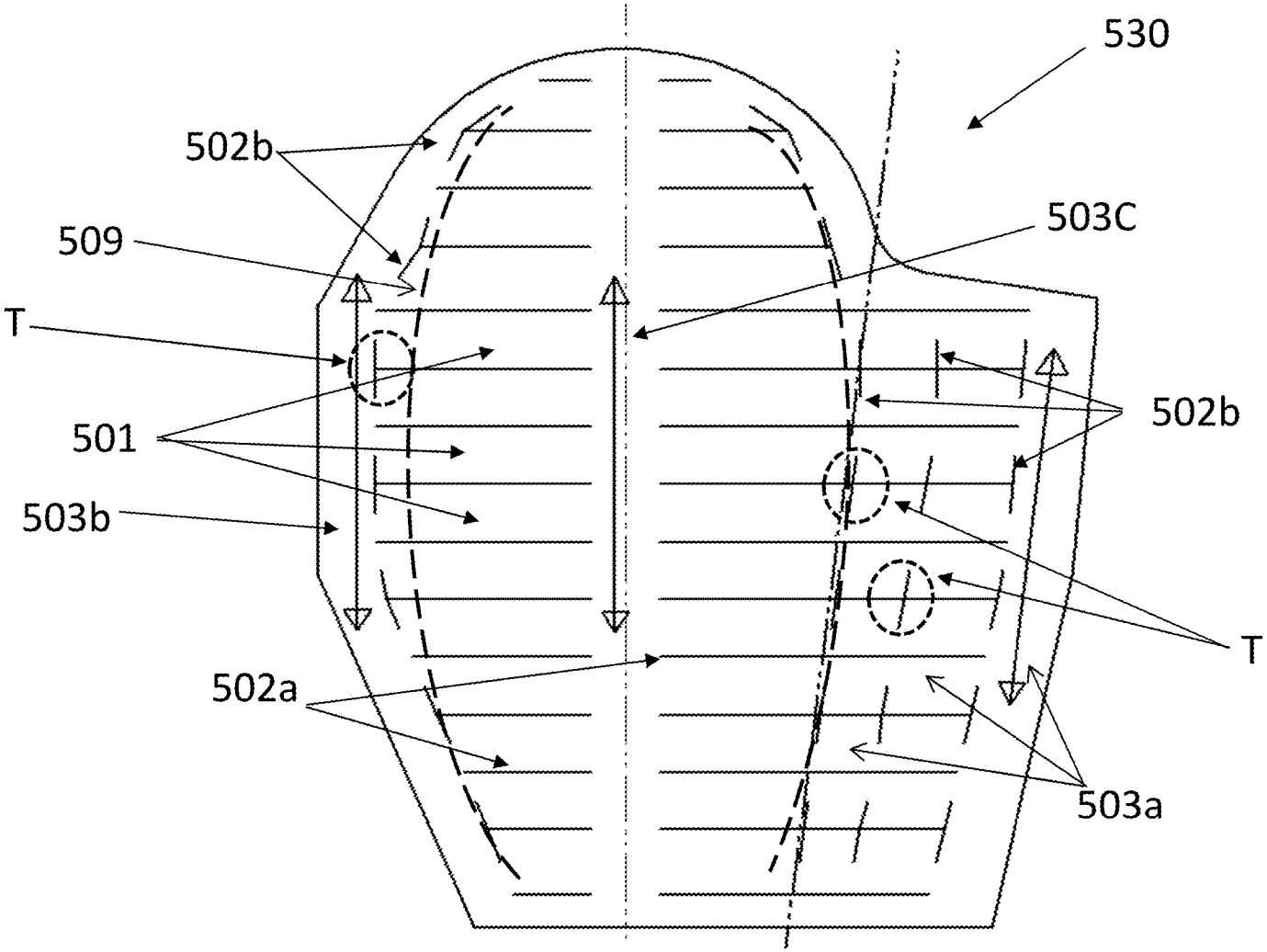
FIG. 5D illustrates a plan view of a sleeping bag according to still another exemplary embodiment of the present inventive concept.

FIG. 5D illustrates a sleeping bag 530 according to yet another exemplary embodiment of the present inventive concept. In this exemplary embodiment, similar to the exemplary embodiment of FIG. 5C, insulating channels 501 extend across almost the entire sleeping bag 530 and are integrated with three storage channels 503*a*. As pointed out in the above described embodiments, the number of storage channels 503*a* can be varied to be fewer in number while wider in size, or more in number while thinner in size. It is also to be noted that this exemplary embodiment can alternatively be applied to a comforter or quilt.

The insulating channels 501 in this exemplary embodiment, similar to the exemplary embodiment of FIG. 5C, are first formed across the bag 530 to extend almost to opposite ends thereof. The insulating channels 501 can be formed by sewing baffles 502*a* widthwise across the sleeping bag 500 almost to opposite ends thereof. Then storage channels 503*a* can be formed by stitching a set of cross baffles 502*b* that cross the baffles 502 along a length from the top to the bottom of the bag 520 at one side thereof, which results in the insulating channels 501 in the main area 509 being integrated with the storage channels 503*a* so that a flow between the insulating channels 501 and the storage channels 503*a* exists, but is partially obstructed, similar to the exemplary embodiment of FIG. 5C. A main area 509 in this exemplary embodiment is located in the same position as that of the exemplary embodiment of FIG. 5C.

Also similar to the exemplary embodiment of FIG. 5C, a movement channel 503*b* can be formed at a side of the sleeping bag 530 opposite the side where the storage channels 503*a* are formed. Similar to the formation of the storage channels 503*a*, the movement channel 503*b* can be integrated with the insulating channels 501 by sewing a second cross baffle 502*b* in sections across ends of every other baffle 502*a* to create T baffles (illustrated by the dotted circle) so that a flow between the insulating channels 501 and the movement channel 503*b* exists, but is partially obstructed.

With this exemplary embodiment, a user can disburse the down feathers throughout the insulating channels 501 in the main area 509, can spread some or all of the down features into the storage channels 503*a*, and/or can spread some of the down feathers into the movement channels 503*b*. By spreading down feathers into the movement channel 503*b*, a user can then disburse the down feathers into any desired insulating channels 501, thus customizing the sleeping bag to have more down feathers at the upper portion of the bag 500 for more upper body insulation, or to have more down feathers at the middle portion of the bag 500 for more mid-body insulation, or to have more feathers at the bottom portion of the bag 500 for more leg/feet insulation. In other words, by moving down feathers into the movement channel

503*b*, the user can then disburse the down feathers from the top of the bag 500 to the bottom of the bag 500 as desired for the user's personal body type comfort level.

Furthermore, a user can also spread the down feathers into each of the insulating channels 501 evenly and to a desired amount so that the feathers can be filled into each of the insulating channels 501 to match the expected environmental temperature during a sleeping period. For example, a user can fill each of the insulating channels 501 to the first temperature indication line 507, which indicates how much down feather fill is required for comfort when the sleeping temperature is expected to be about 60° F., to the second temperature indication line 507, which indicates how much down feather fill is required for comfort when the sleeping temperature is expected to be about 45° F., to a third indication line 507, which indicates how much down feather fill required for comfort when the sleeping temperature is expected to be about 30° F., etc.

In addition to the storage channels 503*a* and the movement channel 503*b*, the sleeping bag according to this exemplary embodiment may also include a second movement channel 503*c* disposed from the top of the sleeping bag 530 to the bottom of the sleeping bag 530 at substantially the middle of the main area 509. This second movement channel 503*c* can provide for quick movement of the down feathers disposed in the insulating channels 501 up toward the top of the sleeping bag 510 or down toward the bottom of the sleeping bag 510 via the second movement channels 503*c*. This additional movement channel 503*c* provides a more expedient process of moving down feathers between the different insulating channels 501, as well as moving more down feathers into the insulating channels 501 or out of the insulating channels 501 when a user requires a quick process of adjusting the temperature comfort level during a quick drop in temperature or a quick rise in temperature during a sleeping period.

The sleeping bag 530 according to this exemplary embodiment is designed to allow a user to move down feathers along the sides thereof from the top to the bottom, into desired insulating channels 501 from top to bottom for personalized comfort levels, into each of the insulating channels 501 to match the expected environmental temperature during a sleeping period, and into storage channels 503*a* to a certain degree in which some or all of the down feathers are not presently needed or are desired to provide a padded bed to rest on. In addition, the sleeping bag 530 according to this exemplary embodiment also provides an additional movement channel 503*c* for a more expedient process of moving the down feathers when environmental temperatures can change rapidly so that a user can rapidly change the insulation amount in the sleeping bag to keep up with temperature changes before becoming uncomfortable due to being subjected to an uncomfortable temperature during a sleeping or resting period.

Figures 5E, 5F, 5G:
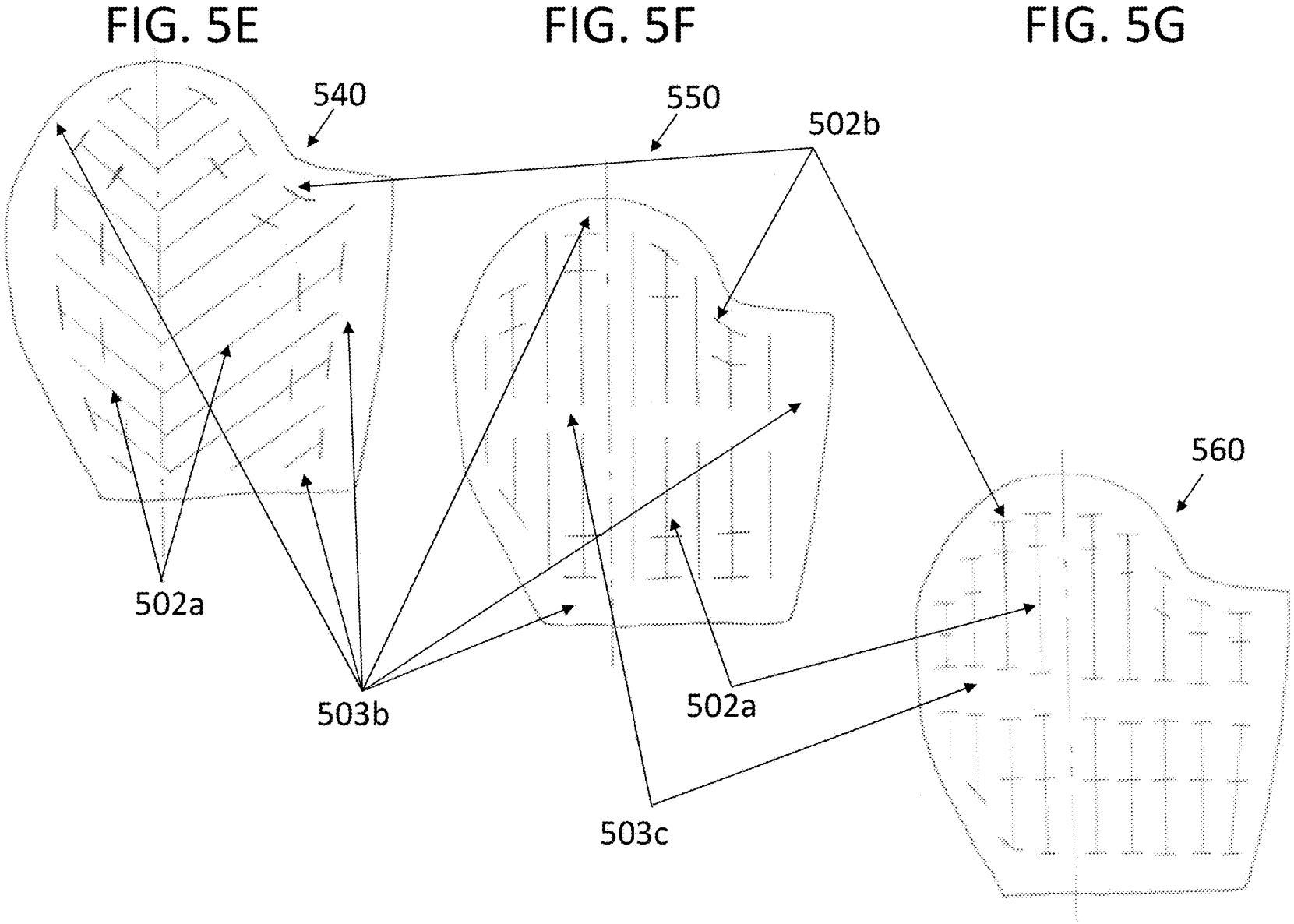
FIG. 5E illustrates an alternative structural design of the exemplary embodiments described above with reference to FIGS. 5A through 5D.
FIG. 5F illustrates another alternative structural design of the exemplary embodiments described above with reference to FIGS. 5A through 5D.
FIG. 5G illustrates still another alternative structural design of the exemplary embodiments described above with reference to FIGS. 5A through 5D.

FIG. 5E, FIG. 5F, FIG. 5G and FIG. 5H illustrate various alternative structural designs of the exemplary embodiments described above with reference to FIGS. 5A through 5D. For example, FIG. 5E illustrates a sleeping bag 540 according to an exemplary embodiment, where baffles 502*a* are disposed in a "chevron design," thus extending upward and outward rather than horizontally across the sleeping bag 540. Also in this alternative exemplary embodiment, there are movement channels 503*b* around the entire sleeping bag 540, and no storage channels are present.

FIG. 5F illustrates another alternative exemplary embodiment of a sleeping bag 550, where baffles 502*a* extend vertically along a sleeping bag 550, and while movement channels 503*b* extend around the sleeping bag 550, a second movement channel 503*c* extends horizontally through a middle section thereof. Moreover, cross baffles 502*b* exist in alternative baffles 502*a*.

FIG. 5G illustrates yet another alternative embodiment of a sleeping bag 560, where baffles 502*a* extend vertically and cross baffles 502*b* exist at each baffle 502*a* rather than on alternate baffles 502*a*. Moreover, cross-baffles 502*b* can occur along each baffle 502*a* in numbers of three, four, five, etc. along the length of each baffle 502*a*.

Figure 5H:
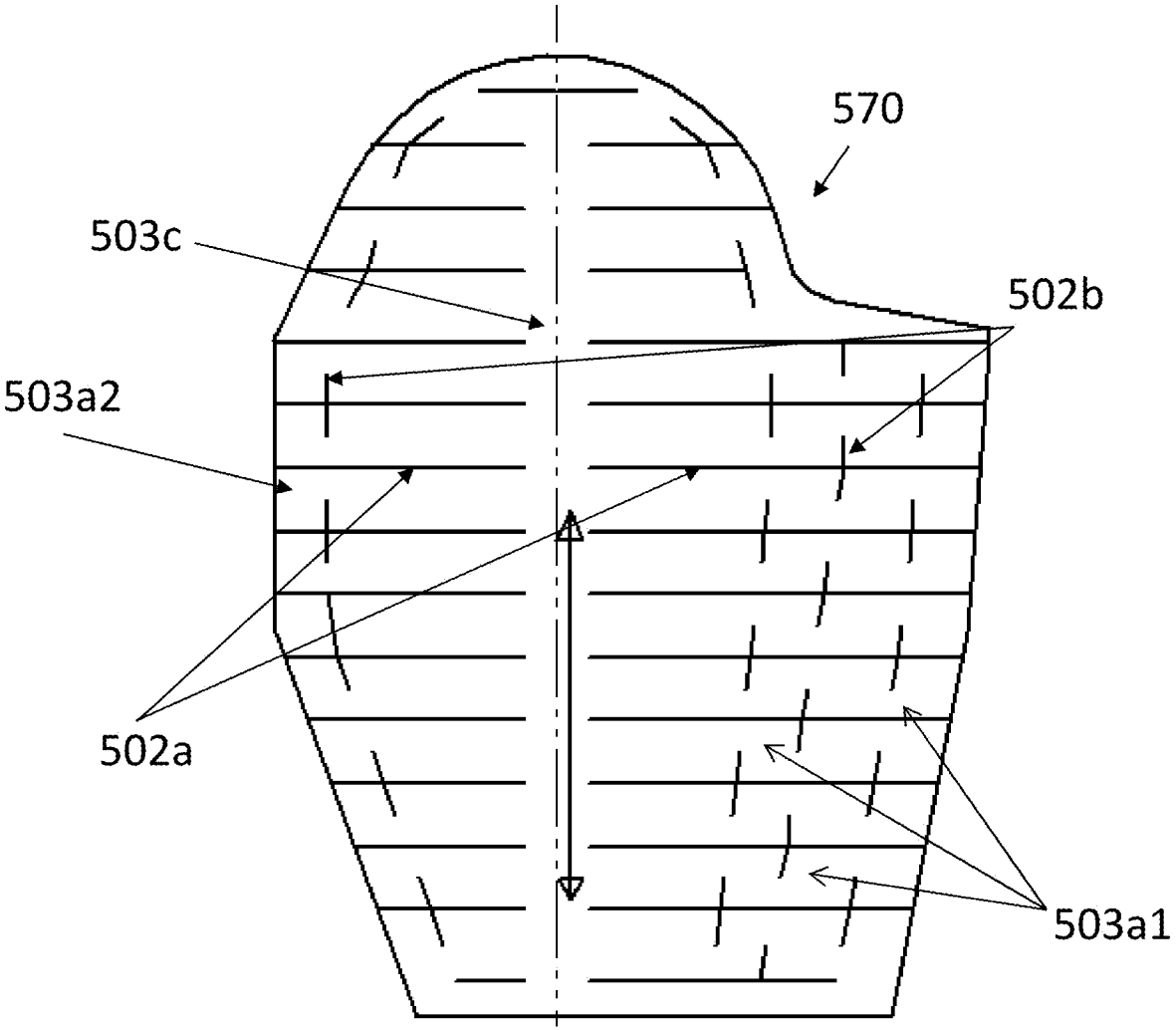
FIG. 5H illustrates yet another alternative structural design of the exemplary embodiments described above with reference to FIGS. 5A through 5D.

FIG. 5H illustrates another alternative exemplary embodiment of a sleeping bag 570, where a set of first storage channels 503*a* 1 are formed at one side thereof, similar to the exemplary embodiment illustrated in FIG. 5B, and a second storage channel 503*a* 2 takes the place of the movement channel 503*b*. With this configuration, a user simply pushes the down feathers towards both the first storage channels 503*a* 1 and the second storage channel 503*a* 2 to cool the sleeping bag 570 down. The down feathers will be trapped at both sides of the sleeping bag 570 due to the baffles 502*b* disposed to cross the baffles 502*a* at each side of the sleeping bag 570. A moving channel 503*c* can be disposed down the middle of the sleeping bag 570 similar to the sleeping bag in the exemplary embodiment illustrated in FIG. 5B.

Figure 6A:
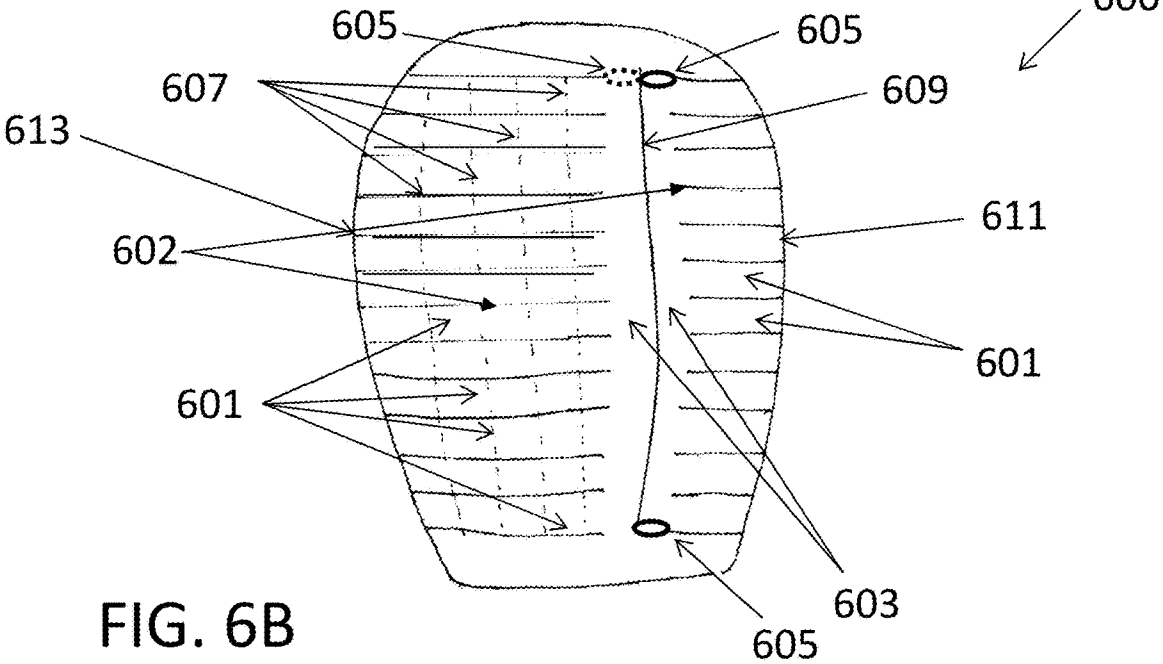
FIG. 6A illustrates a sleeping bag according to yet another example embodiment of the present inventive concept.

FIG. 6A illustrates a sleeping bag 600 according to yet another exemplary embodiment of the present inventive concept. This example embodiment can include insulating channels 601 that extend across a width of the sleeping bag 600 from a top T to a bottom B. Also provided are temperature indication lines 607 disposed vertically from top T to bottom B at predetermined positions spaced apart and adjacent to each other. The predetermined positions of spacing are calculated to be positions corresponding to locations across the sleeping bag 600 where down feathers or other filler insulating material should be filled within each of the insulating channels 601 to match the expected environmental temperature during a sleeping period. The sleeping bag 600 according to this exemplary embodiment can also include a large down feather storage area 611 to store the down feathers or other insulating material when the insulating material is not needed, or when some of the insulating material is desired to act as a padding for a user to sleep on.

This sleeping bag may also include a main area 613, which contains the portion of the insulating channels 601 in which the temperature indication lines 607 can be provided. The main area 613 is generally used as a covering portion to cover a user during a sleeping period, while the storage area 611 is generally used as a padding for resting thereon.

Both the storage area 611 and the main area 613 in this embodiment include the insulating channels 601. This storage area 611 can also include one or more choke points 605. FIG. 6A illustrates one choke point 605 at the bottom of the large storage area 611 and one choke point 605 at the top of the large storage area 611, each provided to restrict to a point that the down feathers are maintained within this storage area 611, when desired. Choke points 605 can also be provided at the entrance to the main area 613 (see dotted circle 605) to prevent down insulation ingress or egress therefrom as a user may move around during a sleeping duration.

The large storage area 611 is separated from the main area 613 of the sleeping bag 600 by a baffle divider 609. The choke points 605 can be sewn between the lowermost baffle stitching line 601 and the uppermost baffle stitching line 601, respectively, and the baffle divider 609. Further, a string can be fed through the sewn choke points 605 to be tightened when a user desires to prevent down feathers from moving between the main area 613 and the storage area 611, and can be loosened when a user desired to move down feathers from the main area 613 or the storage area 611. The choke points 605 can alternatively be made of a plastic or other material that maintains a predetermined shape to allow down feathers to pass through when pushed by a user's hands. As a result of the position and formation of the choke points 605, the down feathers will remain in the large down storage area 611 until they are removed from the insulating channels 601 and pushed through the choke points 605. Similarly, the down will remain in the main area 609 until the down feathers are pushed back through choke points 605.

Figure 6C:
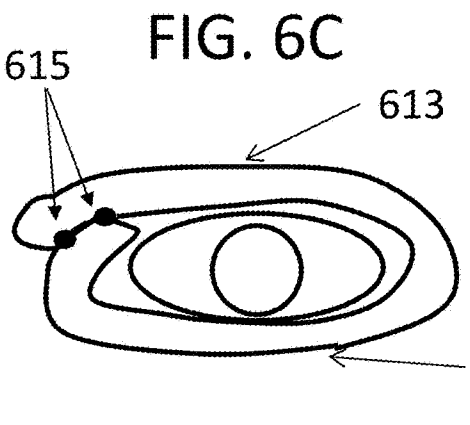
FIG. 6C illustrates the sleeping bag of FIG. 6A in another operating configuration.
Figure 6B:
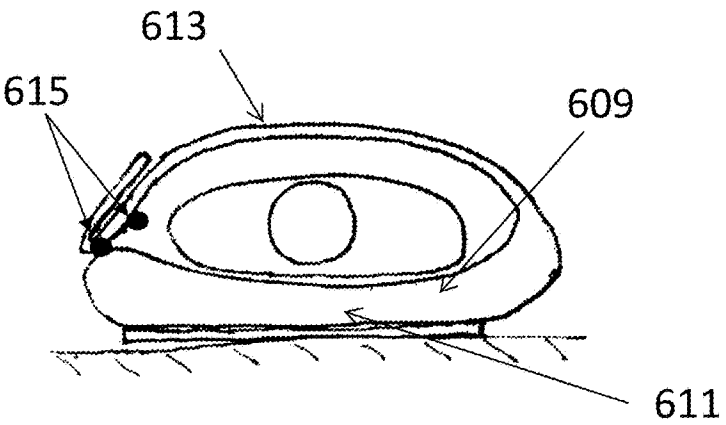
FIG. 6B illustrates the sleeping bag of FIG. 6A in an operating configuration.

FIG. 6B illustrates the sleeping bag 600 of FIG. 6A with most of the down feathers distributed to the insulating channels 601 in the main area 613, where enough down feathers remain in the storage area 611 to act as a soft padding for resting on. Also shown are positions where buttons 615 can be distributed along the entire length of the sleeping bag 600 to fasten the side of the sleeping bag 600 at the main area 613 to the side of the sleeping bag 600 at the storage area 611. Alternatively, the sides of the sleeping bag 600 can be fastened together using a zipper or a hook and loop fastening system.

FIG. 6B and 6C show the benefit of using either buttons or a hook and loop system over a zipper. A comparison of FIGS. 6B and 6C shows that two parallel rows of buttons or hooks (or loops) can provide for a circumferentially loose fitting bag to stretch out in, and by moving the button holes to the next inner row of buttons (or hooks to the next inner row of loops) is snugged tighter around the sleeper, thus making the bag warmer.

Figure 7B:
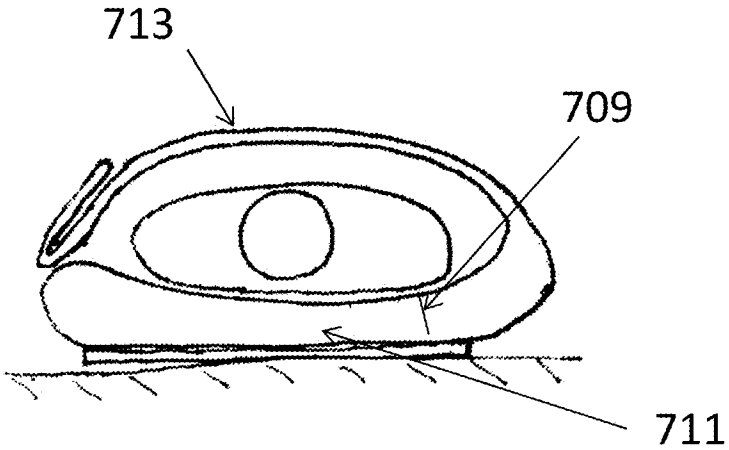
FIG. 7B illustrates a configuration of the sleeping bag of FIG. 7A in an operating configuration.
Figure 7A:
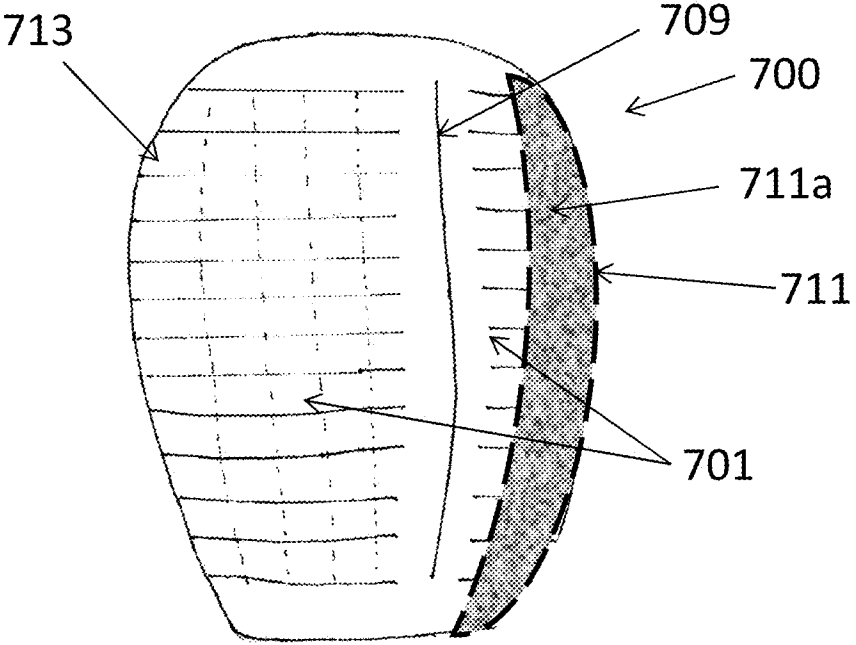
FIG. 7A illustrates a plan view of a sleeping bag according to yet another exemplary embodiment of the present inventive concept.

FIG. 7A illustrates a sleeping bag 700 according to still another example embodiment. This sleeping bag 700 is similar to the sleeping bag 600 illustrated in FIGS. 6A and 6B, however, this sleeping bag 700 according to an exemplary embodiment has a large pocket 711*a* sewn within a large storage area 711, similar to the large storage area 611. This sleeping bag 700 can also include a baffle divider 709 to divide channels 701 formed in a main area 713 from channels 601 formed in the large storage area 711 of the sleeping bag 700.

FIG. 7B illustrates a view of the sleeping bag 700 of FIG. 7A where down feathers are all dispersed in the large storage area 711, which can be used in this configuration as a bed, making sleeping very comfortable on warm evenings when the down feathers are not needed in the main area 713 to keep the user warm. Here the main area 713 can be folded over since it is void of any down feathers.

Figure 8B:
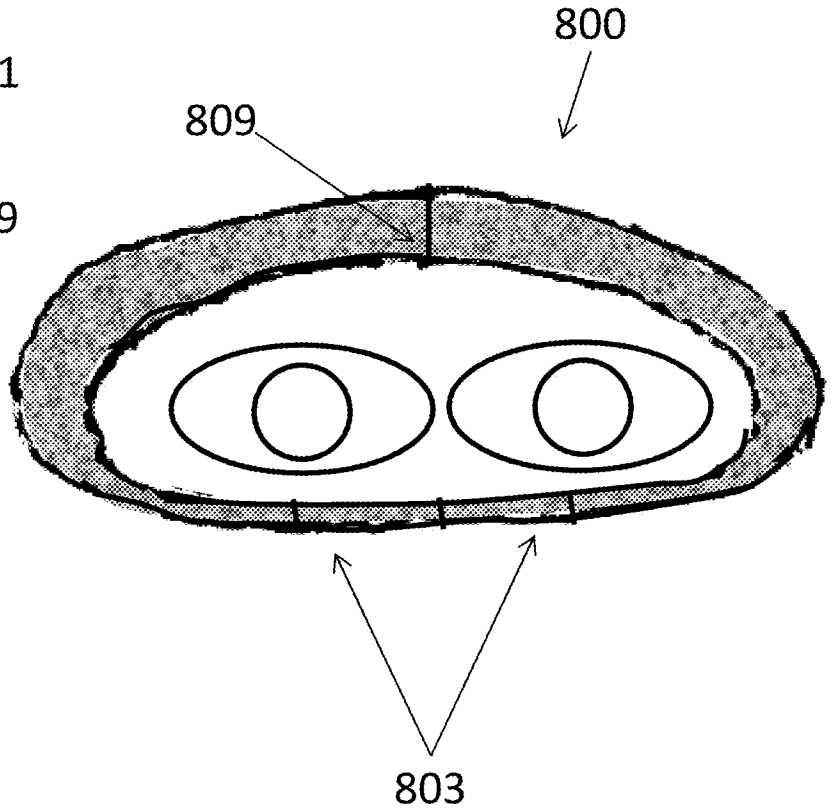
FIG. 8B illustrates a configuration of the sleeping bag of FIG. 8A in an operating configuration.
Figure 8A:
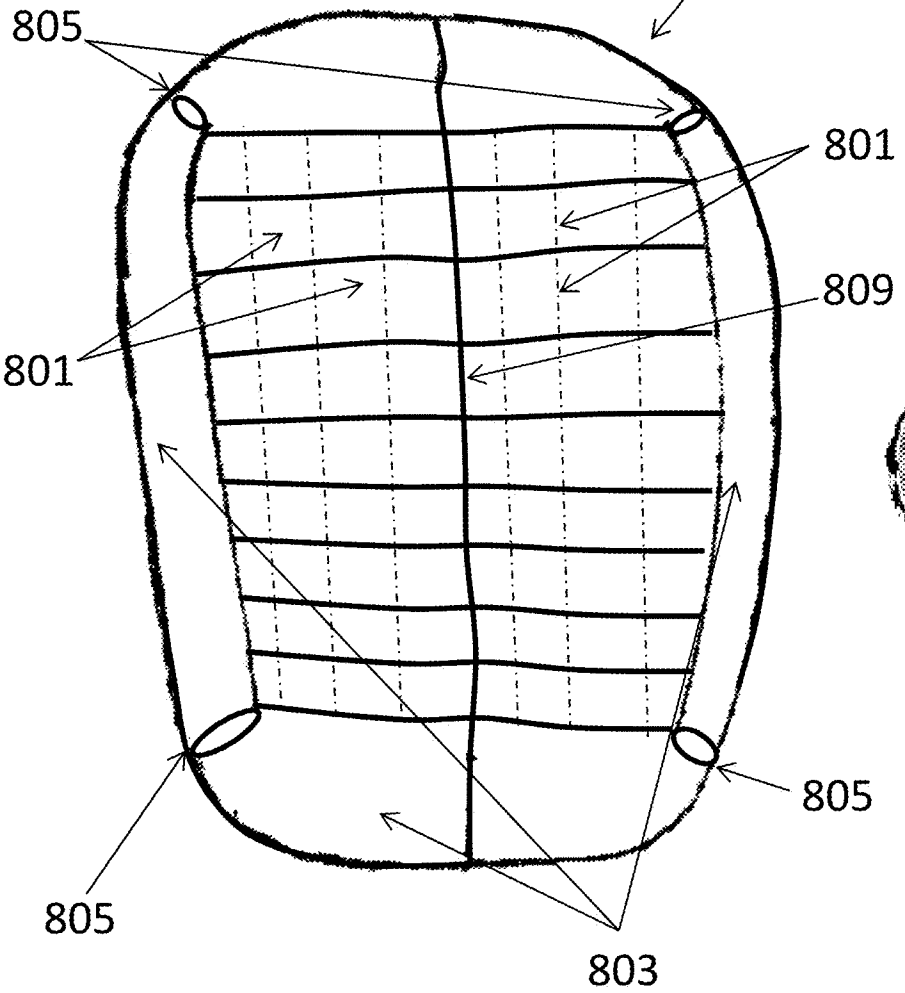
FIG. 8A illustrates a plan view of a sleeping bag according to still another exemplary embodiment of the present inventive concept.

FIG. 8A illustrates a sleeping bag 800 according to yet another example embodiment of the present inventive concept. This sleeping bag 800 is designed for two sleepers. Insulating channels 801 are evenly distributed among two equal halves of the sleeping bag 800, where the halves are divided by a baffle divider 809. Storage channels 803 can store down feathers in order to minimize insulation on top of a user, and choke points 805 are provided, similar to the previous embodiments, to contain the down feathers within the storage areas 803 until the user(s) pushes the down feathers through the choke points 805 and into the insulating channels 801 at each side of the baffle divider 809.

FIG. 8B illustrates a configuration where two users sleep in the sleeping bag 800. Here, all or mostly all of the down feathers are distributed into the channels 801 at each side of the baffle divider 809. The insulating channels 801 with the feathers therein act as a warm cover for each of the users, and the storage channels 803 are underneath the users. Since the storage channels 803 are empty in this configuration, the storage channels 803 will merely hold the sleeping bag 800 in place around the users. This configuration allows the users to set the temperature insulation level of the sleeping bag 800 to their individual preferences.

The sleeping bag 800 illustrated in FIG. 8A can also be configured as a comforter. The comforter can be spread across a bed to cover two users that are sleeping in a bed. Being configured as a comforter, the down feathers can be evenly distributed into each of the insulating channels 801 and storage channels 803.

The various exemplary embodiments as described herein can extend to down insulated clothing such those that use down movement channels, storage areas, channels, and choke points, clothing, such as jackets and parkas, can be also made temperature adjustable over a wide range.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A thermal insulating structure, comprising:

an enclosed shell of material having a front surface and a back surface with a length extending from a top to a bottom thereof and a width extending from a first side to a second side thereof, the length being greater than the width, the enclosed shell comprising:

a plurality of baffles each extending along the width direction and in parallel with each other from the top to the bottom thereof, the plurality of baffles being configured to form a plurality of first channels therebetween, first and second ends of the baffles terminating short of respective first and second sides thereof;

a cross baffle extending along the length direction at the second side thereof and configured to intersect each of the second ends of the plurality of baffles such that each of the first channels formed between the baffles is confined by the baffles and the cross baffle, the cross baffle forming a storage channel with the second side thereof and a space between a bottom most baffle and the bottom thereof and between a top most baffle and the top thereof; and a movement channel extending along a length thereof at the first side thereof and formed between the first side and each of the first ends of baffles such that a flow of insulating material freely moves between the movement channel and each of the plurality of first channels.

2. The thermal insulating structure according to claim 1, further comprising:

a choke point formed between at least one of the first side thereof and the first end of the top most baffle and the first side thereof and the first end of the bottom most baffle, the at least one choke point configured to expand and contract at a point where the storage channel and the movement channel meet.

3. The thermal insulating structure according to claim 2, wherein the thermal insulating structure is a comforter.

4. The thermal insulating structure according to claim 2, further comprising:

a plurality of buttons extending along the length of one of the first side and the second side thereof; and a plurality of button holes extending along the length of opposite one of the first side and the second side thereof, such that each button hole receives and retains a corresponding button.

5. The thermal insulating structure according to claim 2, further comprising:

a hook and loop system with a strip of hooks that adhere to a strip of loops, the strip of hooks being attached along a length of one of the first or second sides of the shell and the strip of loops being attached along a length of the other one of the first or second sides of the shell to adhere to each other such that the first side and the second side of the shell.

6. The thermal insulating structure according to claim 5 further comprising:

a choke point disposed between the beginning of the top most first baffle and the first side of the shell and the beginning of the bottom most first baffle and the first side of the shell, each of the choke points configured to expand and contract to control the flow of insulating material between the first channels and the second channels.

7. The thermal insulating structure according to claim 5, further comprising:

a plurality of temperature indication lines formed on the front surface and extending from the top most first baffle and the bottom most first baffle and each separated predetermined distance, the temperature indications lines being configured to provide an indication of how much insulation material to fill into each of the first channels to provide a certain degree of warmth.

8. The thermal insulating structure according to claim 6, further comprising:

a plurality of buttons extending along the length of one of the first side and the second side thereof; and a plurality of button holes extending along the length of opposite one of the first side and the second side thereof, such that each button hole receives and retains a corresponding button.

9. The thermal insulating structure according to claim 6, further comprising:

a hook and loop system with a strip of hooks that adhere to a strip of loops, the strip of hooks being attached along a length of one of the first or second sides of the shell and the strip of loops being attached along a length of the other one of the first or second sides of the shell to adhere to each other such that the first side and the second side of the shell.

10. The thermal insulating structure according to claim 2, wherein the thermal insulating structure is a sleeping bag.

11. The thermal insulating structure according to claim 1, further comprising:

a plurality of temperature indication lines formed on the front surface and extending along the length thereof from the top most baffle to the bottom most baffle and separated from each other by predetermined distance, the temperature indications lines being configured to provide an indication of how much insulation material to fill into each of the first channels to provide a certain degree of warmth.

12. A thermal insulating structure, comprising:

a shell of material enclosed to form a hollow interior between a front surface, a back surface, a top, a bottom and first and second sides thereof, the shell comprising:

a plurality of first baffles extending between the front and back surfaces thereof to form first channels therebetween, the plurality of first baffles each beginning at a first predetermined distance from the first side thereof and terminating at a second predetermined distance from the second side thereof, the second predetermined distance being greater than the first predetermined distance;

a plurality of second baffles extending between the front and back surfaces thereof to form second channels therebetween, the plurality of second baffles extending between the top and the bottom thereof and being disposed within the second predetermined distance and spaced apart from each other by a third predetermined distance such that a first one of the second baffles extends across the terminating ends of the first baffles to block each of the first channels formed between the first baffles and a last one of the second baffles is disposed away from the second side thereof by the third predetermined distance to form one of the second channels therebetween, each of the second channels having an open communication with a space between a top most first baffle and the top of the shell and with a space between the bottom most baffle and the bottom of the shell.

13. A thermal insulating structure, comprising:

a shell formed of a predetermined material and being enclosed by a front surface and a back surface, a top portion and a bottom portion and a first side and a second side, the second side having a lower portion extending farther away from the first side than an upper portion, the shell comprising:

a first set of baffles each having a first end and a second end and extending widthwise between the first and second sides of the shell to define first channels, the first ends of the first baffles being disposed a predetermined distance from the first side of the shell;

a second set of baffles extending lengthwise along the lower portion of the second side, each of the second baffles being formed in sections, the sections crossing alternate first baffles, each second baffle crossing a first baffle not crossed by an adjacent second baffle such that the second baffles form labyrinths along the lower portion of the second side, and the last second baffle crossing the second end of alternative first baffles to form a second lengthwise channel with the second side of the shell; and a third single baffle extending lengthwise and crossing alternative first ends of the first baffles to form a lengthwise insulation movement channel therebetween.

14. The thermal insulating structure according to claim 13, further comprising:

a plurality of temperature indication lines formed on the front surface and each extending lengthwise a predetermined distance apart between the first ends of the first baffles and the second baffle formed farthest from the second side, the predetermined distance being determined to provide an indication of how much insulation material to fill into each of the first channels to provide a certain degree of warmth.

15. The thermal insulating structure according to claim 14, further comprising:

a plurality of buttons extending along the length of one of the first side and the second side thereof; and a plurality of button holes extending along the length of opposite one of the first side and the second side thereof, such that each button hole receives and retains a corresponding button.

16. The thermal insulating structure according to claim 14, further comprising:

a hook and loop system with a strip of hooks that adhere to a strip of loops, the strip of hooks being attached along a length of one of the first or second sides of the shell and the strip of loops being attached along a length of the other one of the first or second sides of the shell to adhere to each other such that the first side and the second side of the shell.

17. The thermal insulating structure according to claim 14, further comprising:

a second lengthwise insulation movement channel formed through each of the first baffles and disposed an equal distance between the first ends of the first baffles and the second baffle formed farthest from the lower portion of the second side of the shell.

18. A thermal insulating structure, comprising:

a shell formed of a predetermined material and being enclosed by a front surface and a back surface, a top portion and a bottom portion and a first side and a second side, the second side having a lower portion extending farther away from the first side than an upper portion, the shell comprising:

a first set of baffles each having a first end and a second end and extending widthwise between the first and second sides of the shell to define first channels, the first ends of the first baffles being disposed a predetermined distance from the first side of the shell;

a second set of baffles extending lengthwise along the lower portion of the second side, each of the second baffles being formed in sections, the sections crossing alternate first baffles, each of the second baffles crossing the same first baffle to form a row of crosses along alternative first baffles, the last second baffle crossing the second end of alternative first baffles to form a second lengthwise channel with the second side of the shell; and a third single baffle extending lengthwise and crossing alternative first ends of the first baffles to form a lengthwise insulation movement channel therebetween.

19. The thermal insulating structure according to claim 18, further comprising:

a second lengthwise insulation movement channel formed through each of the first baffles and disposed an equal distance between the first ends of the first baffles and the second baffle formed farthest from the lower portion of the second side of the shell.

20. The thermal insulating structure according to claim 18, further comprising:

a hook and loop system with a strip of hooks that adhere to a strip of loops, the strip of hooks being attached along a length of one of the first or second sides of the shell and the strip of loops being attached along a length of the other one of the first or second sides of the shell to adhere to each other such that the first side and the second side of the shell.

* * * * *